US005543826A

United States Patent [19]

Kuronuma et al.

[11] Patent Number: 5,543,826

[45] Date of Patent: Aug. 6, 1996

[54] INK JET APPARATUS AND METHOD FOR RECOVERY THEREOF

[75] Inventors: Akira Kuronuma, Kawasaki; Yuji Akiyama, Yokohama; Takayuki Murata, Kawasaki; Hiroshi Fukui, Yokosuka; Shinichi Omo, Yokohama, all of Japan

[73] Assignee: Canon Kabushiki Kaisha, Tokyo, Japan

[21] Appl. No.: 515,470

[22] Filed: Aug. 15, 1995

Related U.S. Application Data

[63] Continuation of Ser. No. 52,530, Apr. 29, 1993, abandoned.

[30] Foreign Application Priority Data

May 11, 1992 [JP] Japan ..... 4-117293

[51] Int. Cl.[6] ..... B41J 2/165

[52] U.S. Cl. ..... 347/23; 347/30; 347/33

[58] Field of Search ..... 347/17, 23, 29, 347/30, 33, 35, 60

[56] References Cited

U.S. PATENT DOCUMENTS

| | | | |
|---|---|---|---|
| 4,313,124 | 1/1982 | Hara | 347/57 |
| 4,345,262 | 8/1982 | Shirato et al. | 347/10 |
| 4,459,600 | 7/1984 | Sato et al. | 347/47 |
| 4,463,359 | 7/1984 | Ayata et al. | 347/56 |
| 4,558,333 | 12/1985 | Sugitani et al. | 347/65 |
| 4,608,577 | 8/1986 | Hori | 347/66 |
| 4,723,129 | 2/1988 | Endo et al. | 347/56 |
| 4,740,796 | 4/1988 | Endo et al. | 347/56 |
| 5,103,344 | 4/1992 | Gast et al. | 347/33 |
| 5,138,343 | 8/1992 | Aichi et al. | 347/30 |
| 5,302,971 | 4/1994 | Ohba et al. | 347/6 |
| 5,341,163 | 8/1994 | Hanabusa | 347/23 |

FOREIGN PATENT DOCUMENTS

| | | | |
|---|---|---|---|
| 0442438 | 8/1991 | European Pat. Off. | 347/23 |
| 54-056847 | 5/1979 | Japan . | |
| 59-123670 | 7/1984 | Japan . | |
| 59-138461 | 8/1984 | Japan . | |
| 60-071260 | 4/1985 | Japan . | |
| 63-224960 | 9/1988 | Japan | 347/23 |
| 4-147865 | 5/1992 | Japan | 347/23 |
| 5-84926 | 4/1993 | Japan | 347/23 |

*Primary Examiner*—John E. Barlow, Jr.
*Attorney, Agent, or Firm*—Fitzpatrick, Cella, Harper & Scinto

[57] ABSTRACT

An ink jet apparatus carries out a recovery operation if a cap member is not capping a discharge opening when the ink jet apparatus is turned on. The recovery operation includes first wiping a discharge surface with a wiper member, next capping the discharge opening with the cap member, next applying suction to draw ink from the discharge opening using a suction pump, and thereafter discharging ink through the discharge opening, thereby enabling recording of high quality at the beginning of recording after the ink jet apparatus is turned on. The recovery operation may include other steps and be preceded by heating the ink jet head to reduce ink viscosity and enhance the effectiveness of the recovery operation.

35 Claims, 19 Drawing Sheets

INK JET APPARATUS AND METHOD FOR RECOVERY THEREOF

This application is a continuation of application Ser. No. 08/052,530 filed Apr. 29, 1993 now abandoned.

BACKGROUND OF THE INVENTION

1. Field of the Invention

The present invention relates to an ink jet apparatus, and more particularly to an ink jet recording apparatus with which recording is carried out by discharging ink from a recording head onto a recording medium. The present invention also relates to a method for recovery of an ink jet apparatus, and more particularly to a method for recovery of an ink jet recording apparatus.

2. Related Background Art

A recording apparatus records images (the term "images" herein includes characters) according to image information (the term "image information" herein includes character information or the like) on a recording medium such as paper, a thin plastic film, textiles or any other medium capable of having an image recorded thereon. Such a recording apparatus can function as a printing machine, a copying machine, a facsimile machine and so on, or as an output terminal of a composite electronic machine, such as a work station or the like, functioning as a computer, a word processor and so on. Such a recording apparatus can be characterized by its recording method as an ink jet apparatus, a wire dot apparatus, a thermal printing apparatus, a laser beam apparatus and so on.

In a serial-type recording apparatus using a serial scanning method, in which main scanning is carried out in a main scan direction transverse to a sub-scan direction of conveyance of a recording medium, the recording of images is carried out by a recording means carried on a carriage which moves in the main scan direction along a recording medium after the recording medium is positioned at a predetermined recording region. After recording of one line is finished, a predetermined amount of conveyance of the recording medium in the sub-scan direction is carried out. Then recording of the next line on the stationary recording member is carried out. The main scanning and the sub-scanning are repeated alternately. In this way, recording on the whole recording medium is carried out.

On the other hand, in a line-type recording apparatus, in which the only movement is the sub-scanning of a recording medium, recording of one line is carried out at almost the same time the recording member is positioned at a predetermined recording region. Then a predetermined amount of conveyance of the recording medium (a pitch of one line) is carried out and recording of the next line is carried out at almost the same time. The one-line recording and the sub-scanning are repeated alternately. In this way, recording of the whole recording medium is carried out.

Among the foregoing recording apparatuses, an ink jet recording apparatus carries out recording by discharging ink from a recording head to a recording medium. An ink jet recording apparatus has many advantages. It is relatively easy to make the recording means compact. Images with a high density can be recorded rapidly. Recording on plain paper can be carried out without special treatment of the paper. The running cost is relatively low. Recording can be carried out quietly because it uses non-impact method. In addition, it is easy to carry out color recording by using a plurality of color inks. Especially, a line-type ink jet recording apparatus with a type full-line type recording means which has a plurality of discharge openings extending over the width of a recording area of a paper can carry out recording rapidly.

Particularly, an ink jet recording head utilizing thermal energy to discharge ink can be made very compact. One of the reasons for the compact design resides in the manufacturing method used to make the head. That is, a typical ink jet recording head with a high density of liquid paths (or discharge openings) can be manufactured easily by providing members for forming walls of liquid paths, a top plate and so forth on a heater board member with electro-thermal converting bodies through semiconductor manufacturing processes such as etching, deposition, sputtering or the like.

FIG. 1 is a schematic vertical cross sectional view showing an ink discharging portion of an ink jet recording head 90. As illustrated in FIG. 1, a plurality of discharge openings 10 are provided at a certain pitch in a substantially vertical direction on a surface of a recording head 90, which is positioned opposed to a recording medium 1, such as recording paper, which leaves a certain gap (for example, about 0.5 to 2.0 mm) from the surface. A heat generating portion 11 of an electro-thermal converting body for generating thermal energy to be utilized to discharge ink is provided on a wall of each liquid path 10A which communicates between a common liquid chamber 10B and each discharge opening 10. The ink jet recording head 90 is carried on a carriage (which is not shown in FIG. 1) so that the discharge openings 10 are disposed in line transverse to the direction of the movement of the carriage (the main scanning direction). Ink is discharged as a droplet 12 from a selected discharge opening 10 of the recording head 90 by driving the corresponding electro-thermal converting body according to a discharge signal to generate a bubble 11A by film boiling of the ink in the corresponding liquid path 10A. Referring to FIG. 1, heat drivers 13 to be turned on and off are provided corresponding to each of the discharge openings 10 of the recording head 90 to provide discharge signals to each of the electro-thermal converting bodies. A circuit board of a driving circuit to drive the heat drivers 13 is carried, for example, on the carriage.

FIG. 2 is a schematic perspective view showing a main portion of a color ink jet recording apparatus of a serial scanning type with a recovery means for carrying out a recovery treatment of recovering or preventing clogging of a discharge opening of an ink jet recording head and the resulting deterioration of an ink discharge condition from the discharge opening. As illustrated in FIG. 2, a recording head 511Y for discharging yellow color ink (Y), a recording head 511M for discharging magenta color ink (M), a recording head 511C for discharging cyan color ink (C), and a recording head 511K for discharging black ink (Bk) are carried on a carriage 512, which is supported along a guide rail 513 to move in a reciprocating manner. A recording medium 514 is conveyed in a sub-scanning direction transverse to a main scanning direction of a movement of the carriage 512 and the recording heads 511 through a recording area, which is in a range of the movement of the carriage 512. In the recording area, a predetermined gap (a flying distance of a droplet, for example 0.5 to 1.5 mm) is provided between a front surface (a surface on which discharge openings are provided) of the recording heads 511 and a recording surface of the recording medium 514.

The movement of the carriage 512 is carried out through a timing belt 521 by driving a carriage motor (a main scanning motor) 520 in either direction. Conveyance of the recording medium 514 from a tray 522 is carried out by conveying rollers 515, 516. Maintaining a position of the recording medium 514 in the recording area is carried out by guiding and supporting a reverse side of the recording medium 514 on a platen 525.

The multiple color recording of one line onto the recording medium 514 is carried out by discharging ink from selected discharge openings in the order of Y, M, C and Bk in response to image signals in synchronism with the movement (main scanning) of the recording heads 511 while the recording medium 514, which is disposed in the recording area, is suspended. Timings of discharging each color ink are controlled by the output from a control circuit, which is not illustrated in FIG. 2, according to signals which are read by an encoder 517. After recording of the one line, the conveyance (sub-scanning) of the recording medium 514 for one line is carried out. Then the recording of the next line is carried out again as the recording heads 511 move (main scanning). The main scanning and the sub-scanning are repeated alternately. In this way, desired images are printed on the recording medium 514. Numerals 523*a*, 523*b* designate ink reservoirs which contain ink to be supplied through an ink tube member 524 to the respective ink jet recording heads 511.

A recovery apparatus for maintaining and recovering a discharge capability of the recording heads 511 is generally situated at a predetermined position, for example a home position of the carriage 512, which is in the range of the movement of the carriage 512 but out of the recording area. This recovery apparatus has cap members 508 for covering and closing tightly discharge openings of each recording head from the atmosphere, a cleaning wiper member 519 for wiping off extraneous matter like viscous ink on the surface of the discharge openings of each recording head, and a suction pump (which is not illustrated in FIG. 2) connected to the cap members 508 for carrying out the suction recovery by exerting a suction force on the discharge openings when they are covered by the cap members 508.

The cap members 508 are generally made of non-gas-permeable elastic and prevent clogging of the discharge openings by extraneous matter such as viscous ink or dust. For example, in case recording is not carried out for a certain time in an ink jet recording apparatus, the cap members 508 cap the recording heads.

The cleaning wiper member 519 is generally made of a plate-shaped elastic body such as urethane rubber and can be moved back and forth with a holder 518 of the cleaning wiper member 519 by a driving means which is not illustrated in FIG. 2. In case wiping of the surface of the discharge openings is necessary, the cleaning wiper member 519 is moved forward by the driving means and the surface of the discharge openings makes contact with the cleaning wiper member 519 by utilizing the movement of the carriage 512.

In addition, another recovery treatment involving idle ink discharges (pre-discharges) can be performed at the home position by discharging ink (for example, into the cap members 508) according to discharge signals.

In an ink jet recording apparatus, when a power source of the apparatus is turned on, recovery control (warming-up control), which includes the foregoing recovery processes, is carried out to ensure the head is in condition for making a recording of high quality.

Whether the discharge openings are covered by the cap members or not when the power source is turned on depends in most apparatuses whether they were covered when the apparatus was last turned off. If the power source was turned off before capping was carried out, for example by power failure, there is a possibility that the discharge openings have been left uncapped for a long time.

Warming-up recovery control according to the related background art has encountered some drawbacks. When the power source is turned on, previous approaches assumed that the discharge openings were capped, regardless of the actual situation. Therefore, for example, if the power source of the ink jet recording apparatus was turned off before the discharge openings were capped, and the discharge openings have thus been left without being capped for a long time, the usual warming-up recovery control may not be able to maintain the desired level of recording quality because the viscosity of ink is increased. In other words, there is a possibility that ink will not be discharged and recording will not be carried out when the ink jet recording apparatus is operated.

On the other hand, it would not solve the problem to assume that the discharge openings were not capped regardless of the actual situation. That would involve always performing recovery processes when the apparatus is turned on, thus unnecessarily using ink and spending time if the discharge openings had been capped when the apparatus was turned off.

In addition, some ink jet recording apparatuses include a control sequence in which the discharge openings are capped automatically when the power source is turned off. However, in that case the control circuitry becomes more complicated and therefore increases the apparatus cost and the automatic sequence may not work if the power supply is interrupted by something other than turning off the power swatch.

SUMMARY OF THE INVENTION

The present invention has been developed in consideration of the above situation. It is an object of the present invention to provide an improved ink jet apparatus and an improved method for recovery of an ink jet apparatus each of which can overcome the problems described above.

It is another object of the present invention to provide an ink jet apparatus and a method for recovery of an ink jet apparatus each of which can prevent deterioration of recording quality, especially at the beginning of recording after the power source of the ink jet apparatus is turned on.

It is still another object of the present invention to provide an ink jet apparatus and a method for recovery of an ink jet apparatus each of which can carry out recording of high quality even if a discharge opening of an ink jet head is uncapped when the power source of the ink jet apparatus is turned on.

It is further another object of the present invention to provide an ink jet apparatus and a method for recovery of an ink jet apparatus each of which can prevent waste of ink by carrying out recovery on an appropriate scale.

According to one aspect of the present invention, an ink jet apparatus comprises an ink jet head having a discharge surface with a discharge opening for discharging ink therethrough in response to discharge signals, a cap member for capping the discharge opening, a wiper member for wiping the discharge surface, suction means for applying suction to the discharge opening through the cap member to draw ink from the discharge opening, and control means for carrying out a recovery operation if the cap member is not capping the discharge opening when the ink jet apparatus is turned on, the recovery operation including first wiping the discharge surface with the wiper member, next capping the discharge opening with the cap member, next applying suction to draw ink from the discharge opening using the suction means, and thereafter discharging ink through the discharge opening using discharge signals.

According to another aspect of the present invention, an ink jet apparatus comprises an ink jet head having a discharge surface with a discharge opening for discharging ink therethrough in response to discharge signals, a cap member for capping the discharge opening, a wiper member for wiping the discharge surface, and control means for carrying out a recovery operation when the ink jet apparatus is turned on, the recovery operation including wiping the discharge surface with the wiper member and discharging ink through the discharge opening using discharge signals, wherein the control means carries out an additional recovery operation if the cap member is not capping the discharge opening when the ink jet apparatus is turned on.

According to yet another aspect of the present invention, and ink jet apparatus comprises an ink jet head having a discharge opening for discharging ink therethrough, a heater for controlling the temperature of the ink jet head, a cap member for capping the discharge opening, and control means for operating the heater to bring the ink jet head to a first temperature if the cap member is capping the discharge opening when the ink jet apparatus is turned on and to bring the ink jet head to a second temperature higher than the first temperature if the cap member is not capping the discharge opening when the ink jet apparatus is turned on.

According to a further aspect of the present invention, a recovery method for an ink jet apparatus that includes an ink jet head having a discharge surface with a discharge opening for discharging ink therethrough in response to discharge signals, a cap member for capping the discharge opening, a wiper member for wiping the discharge surface, and suction means for applying suction to the discharge opening through the cap member to draw ink from the discharge opening, the recovery method being performed if the cap member is not capping the discharge opening when the ink jet apparatus is turned on, comprises the steps of first wiping the discharge surface with the wiper member, next capping the discharge opening with the cap member, next applying suction to draw ink from the discharge opening using said suction means, and thereafter discharging ink through the discharge opening using discharge signals.

According to a still further aspect of the present invention, a recovery method for an ink jet apparatus that includes an ink jet head having a discharge surface with a discharge opening for discharging ink therethrough in response to discharge signals, a cap member for capping the discharge opening, a wiper member for wiping the discharge surface, and control means for carrying out a recovery operation when the ink jet apparatus is turned on, comprises the steps of performing a recovery operation including wiping the discharge opening with the wiper member and discharging ink through the discharge opening using discharge signals if the cap member is capping the discharge opening when the ink jet apparatus is turned on, and performing an additional recovery operation if the cap member is not capping the discharge opening when the ink jet apparatus is turned on.

According to a yet further aspect of the present invention, a recovery method for an ink jet apparatus that includes an ink jet head having a discharge surface with a discharge opening for discharging ink therethrough, a heater for controlling the temperature of the ink jet head, and a cap member for capping the discharge opening, comprises operating the heater to bring the ink jet head to a first temperature if the cap member is capping the discharge opening when the ink jet apparatus is turned on, and operating the heater to bring the ink jet head to a second temperature higher than the first temperature if the cap member is not capping the discharge opening when the ink jet apparatus is turned on.

Other objects, features and advantages of the present invention will become apparent from the following detailed description of the preferred embodiments of the present invention and the accompanying drawings.

DESCRIPTION OF THE PREFERRED EMBODIMENTS

Figure 3:
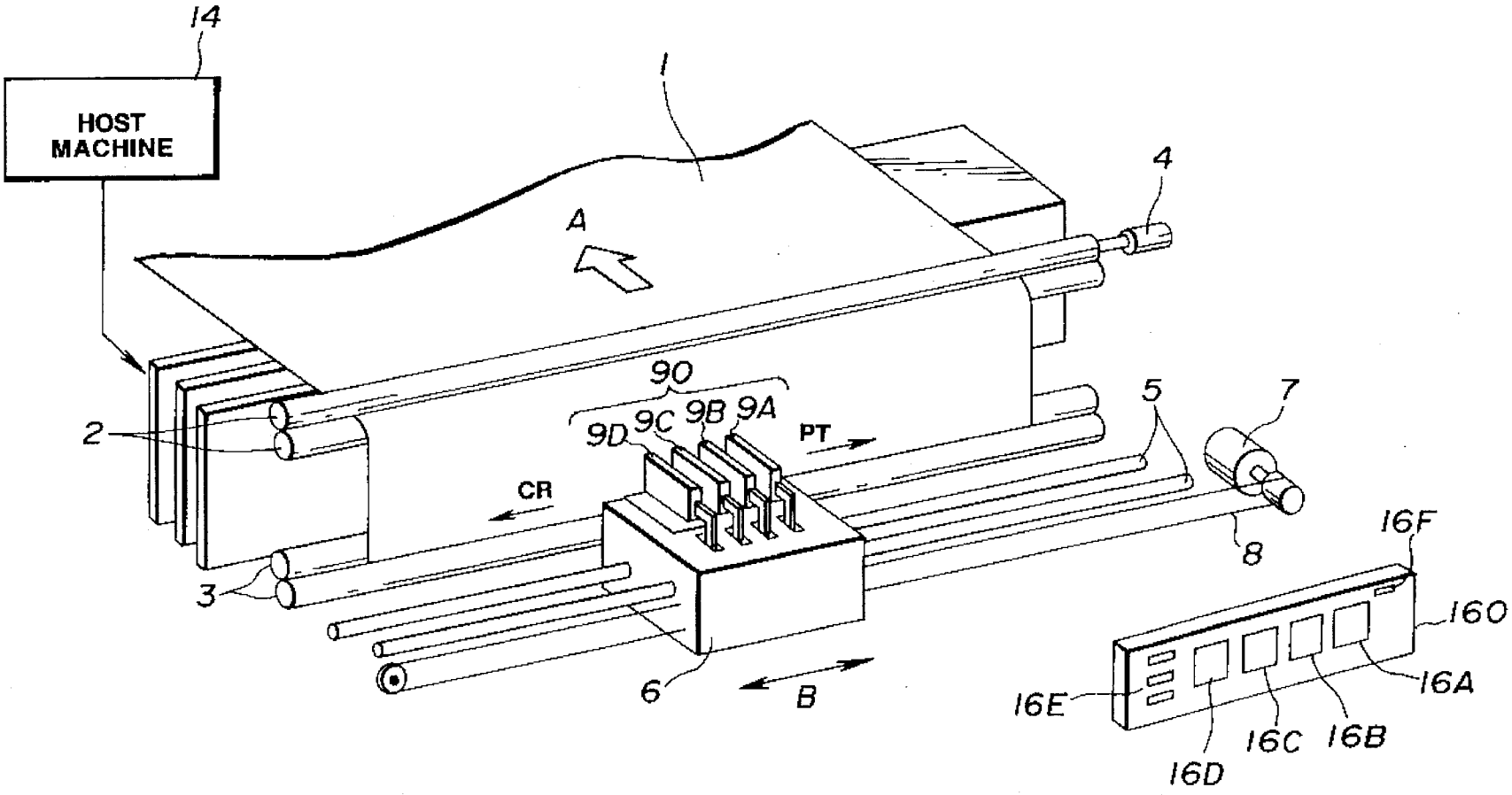
FIG.3 (PRIOR ART)
FIG. 3 is a schematic perspective view showing a main portion of a color ink jet recording apparatus used to illustrate the present invention.

Referring now to the drawings, the preferred embodiments of the present invention will be described in detail. FIG. 3 is a schematic perspective view showing a main portion of an color ink jet recording apparatus for explaining an embodiment of the present invention. As illustrated in FIG. 3, a recording head 9A for discharging black ink (Bk), a recording head 9B for discharging cyan color ink (C), a recording head 9C for discharging magenta color ink (M), and a recording head 9D for discharging yellow color ink (Y) are carried on a carriage 6, which is supported along guide rails 5 to move in a direction PT or in a direction CR in FIG. 3. A recording medium 1 such as paper, a plastic sheet or a cloth sheet is conveyed in a sub-scanning direction transverse to the main scanning movement of the carriage 6 (the direction of movement of the recording heads 90) through a recording area, which is in a range of the movement of the carriage 6. In the recording area a predetermined gap (a flying distance of a droplet, for example 0.8 mm) is provided between a front surface (a surface on which discharge openings are provided) of the recording heads 90 and a recording surface of the recording medium 1. On the front surface of each ink jet recording head, there are plural (for example 48 or 64) discharge openings situated in a line substantially transverse to the main scanning direction of the movement of the carriage 6.

Figure 1:
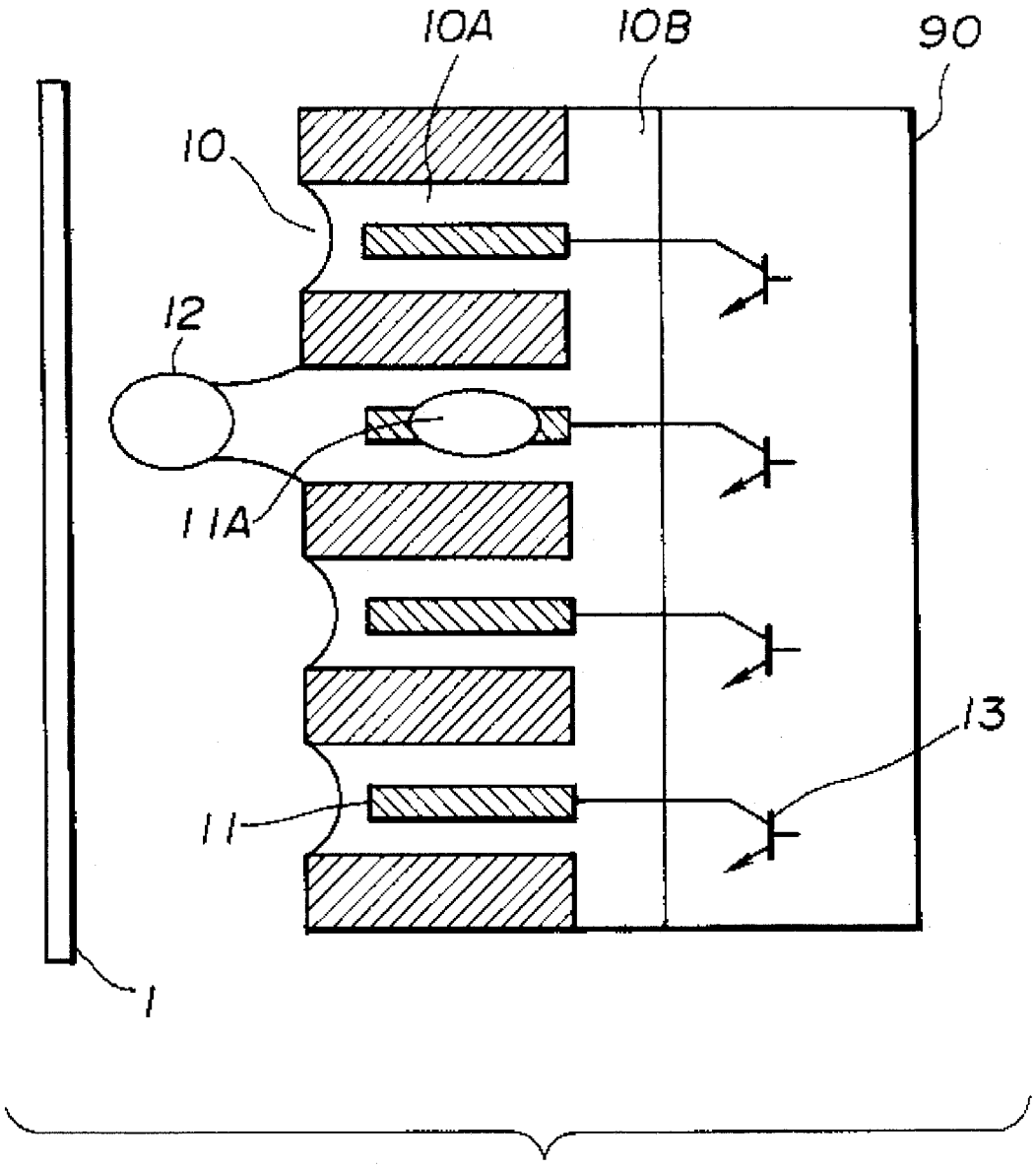
FIG.1 (PRIOR ART)
FIG. 1 is a schematic cross sectional view showing an ink discharging portion of a conventional ink jet recording head.
Figure 2:
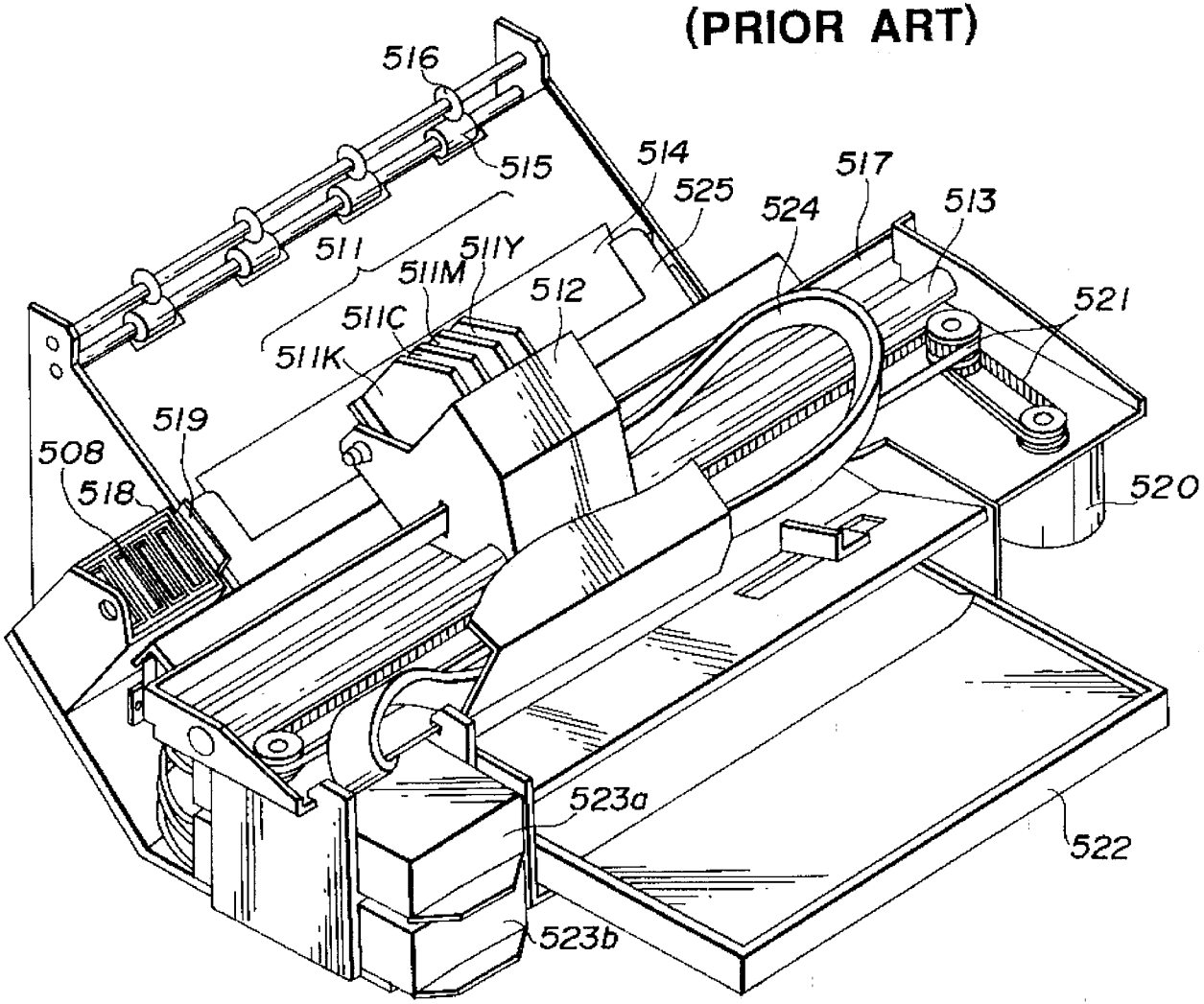
FIG.2 (PRIOR ART)
FIG. 2 is a schematic perspective view showing of a main portion of a conventional color ink jet recording apparatus.

The movement of the carriage 6 is carried out in the direction of arrow B through a wire 8 by driving a carriage motor (a main scanning motor) 7 in either direction. Conveyance of the recording medium 1 is carried out in the direction of arrow A by conveying rollers 3 and conveying rollers 2, one of which is driven by a conveying motor 4. The multiple color recording of one line onto the recording medium 1 is carried out by discharging ink from selected discharge openings in the order of Y, M, C and Bk in response to image signals in synchronism with the movement (main scanning) of the recording heads 90 while the recording medium 1, which is disposed in the recording area, is suspended. Timings of the discharge of each color ink are controlled by output from a control circuit. After the recording of one line, the conveyance (sub-scanning) of the recording medium 1 for one line is carried out. Then the recording of the next line is carried out as the recording heads 90 move (main scanning). The main scanning and the sub-scanning are repeated alternately. In this way, desired images are printed on the recording medium 1. A recovery apparatus similar to that in FIG. 2 is provided at the home position of the ink jet recording apparatus, but the recovery apparatus is not illustrated in FIG. 3.

Numeral 160 designates an operation panel provided on a case (which is not illustrated in FIG. 3) of the ink jet recording apparatus. On the operation panel 160, there is not only a key setting portion containing an on-line/off-line switching key 16A, a line feed key 16B, a form feed key 16C, and a recording mode switching key 16D, but also an indication portion containing plural warning lamps such alarm lamps 16E and a power source lamp 16F.

Figure 4:
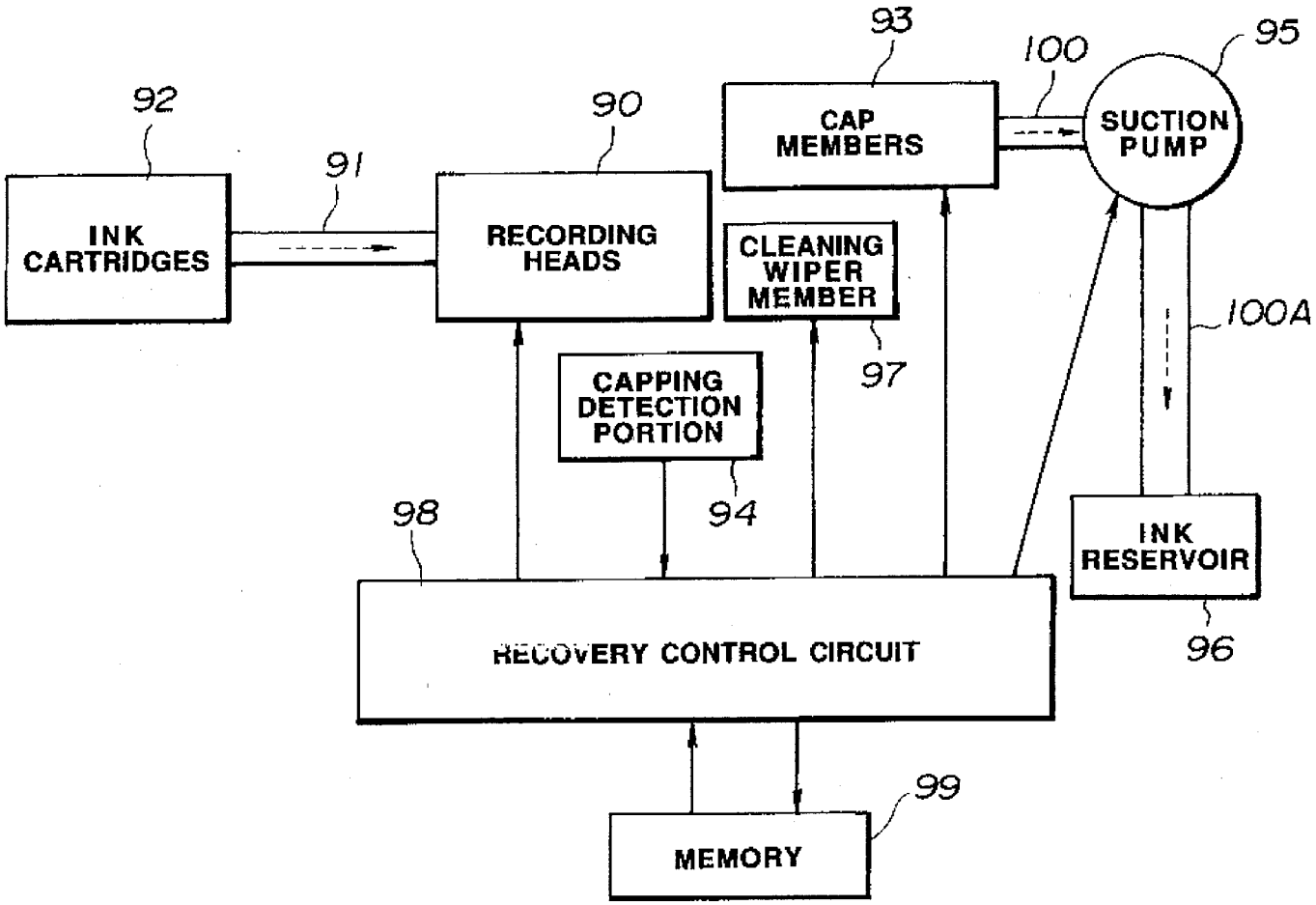
FIG. 4 is a schematic block diagram showing the basic structure of the color ink jet recording apparatus shown in FIG. 3.

FIG. 4 is a schematic block diagram showing a basic structure of the color ink jet recording apparatus shown in FIG. 3. In FIG. 4, ink is supplied from ink cartridges 92 which are set in the ink jet recording apparatus through ink supply passages 91 to the ink jet recording heads 90 (the ink cartridges 92 and the ink supply passages 91 are not illustrated in FIG. 3).

Numeral 97 designates a cleaning wiper member for wiping the surface of the discharge openings. Numeral 93 designates the cap members which cover the discharge openings of the ink jet recording heads 90. (See FIG. 2.) Numeral 95 designates a suction pump which generates a negative pressure to suck ink and so on from the discharge openings through the cap members 93 and a sucked ink passage 100 by a drive of a suction motor which is not illustrated in FIGS. 3, 4. Waste ink from the suction pump is sent to waste ink reservoir 96 through a waste ink passage 100A. Numeral 94 designates a capping detection portion to detect whether the cap members 93 cover the discharge openings or not.

Numeral 98 designates a recovery control circuit which causes the ink jet recording heads 90, the cleaning wiper member 97, the cap members 93, the suction pump 95 and so on to carry out recovery operations according to an output from the capping detection portion 94. Numeral 99 designates a memory which memorizes the steps of the recovery operations which differ from each other according to whether or not capping is carried out when the power source is turned on.

Figure 5:
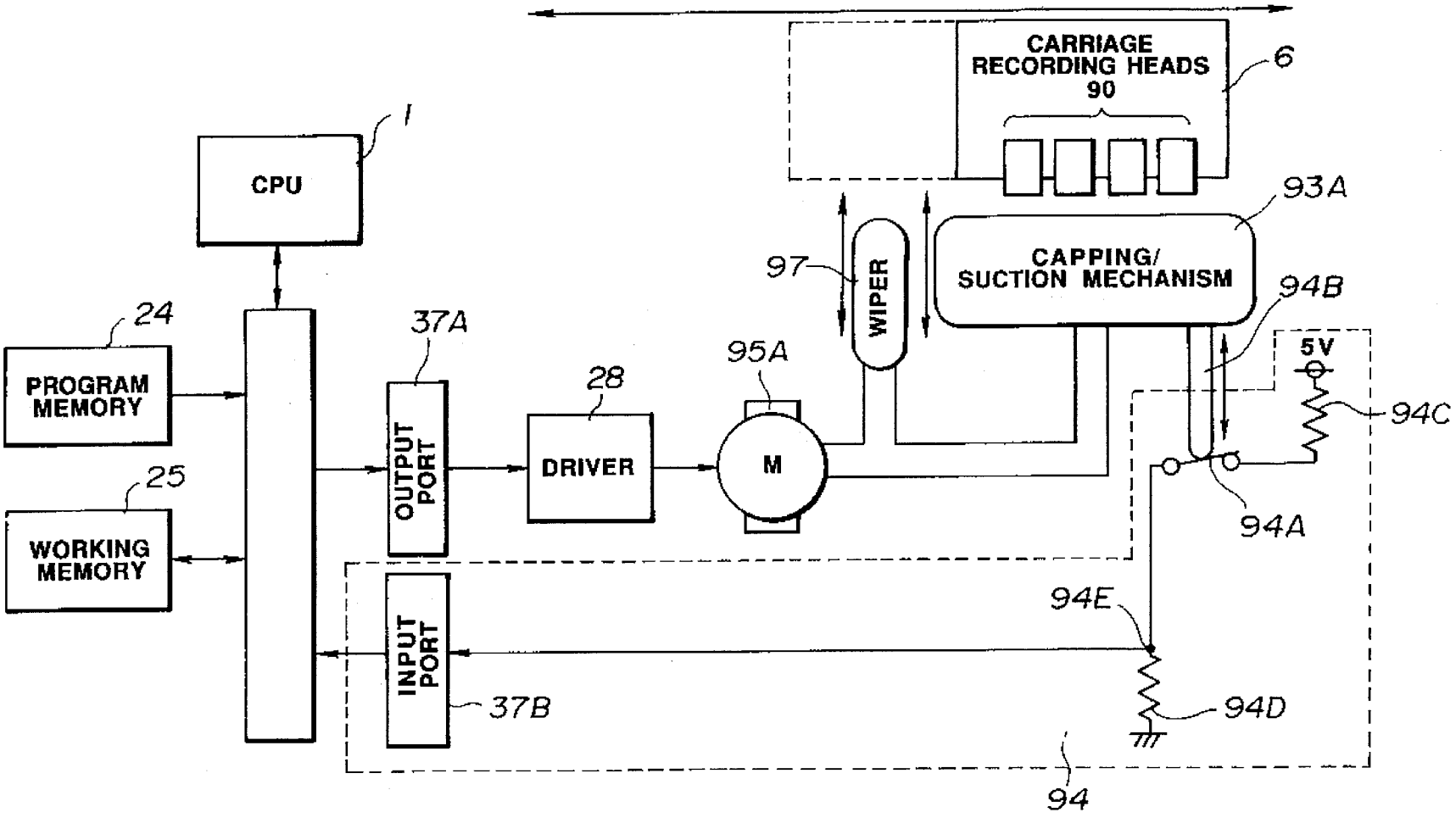
FIG. 5 is a schematic block diagram for explaining the capping detection portion shown in FIG. 4.

FIG. 5 is a schematic block diagram for explaining the capping detection portion 94 shown in FIG. 4. The capping detection portion 94 is surrounded by a dotted line in FIG. 4 and is constituted basically by a mechanical switch 94A and resistors 94C and 94D. If the discharge openings of the ink jet recording heads 90 on the carriage 6 are covered by the cap members (numeral 93A in FIG. 5 designates a capping/suction mechanism containing the cap members), a probe 94B located on the side of the recording heads 90 allows the mechanical switch 94A to open so that the current does not flow to an input port 37B.

If the discharge openings of the ink jet recording heads 90 are not covered by the cap members, the probe 94B closes the mechanical switch 94A and current flows from a power source (5 V) to the input port 37B through a resistance 94C and the switch 94A. If the resistance 94C is 1 kilo-ohm and the resistance 94D is 4 kilo-ohm, a divisional voltage at a point 94E is 4 V. A CPU 21 interprets whether or not the discharge openings of the ink jet recording heads 90 are covered by the cap members by comparing the voltage of current input into the input port 37B to a predetermined threshold value.

Figure 6:
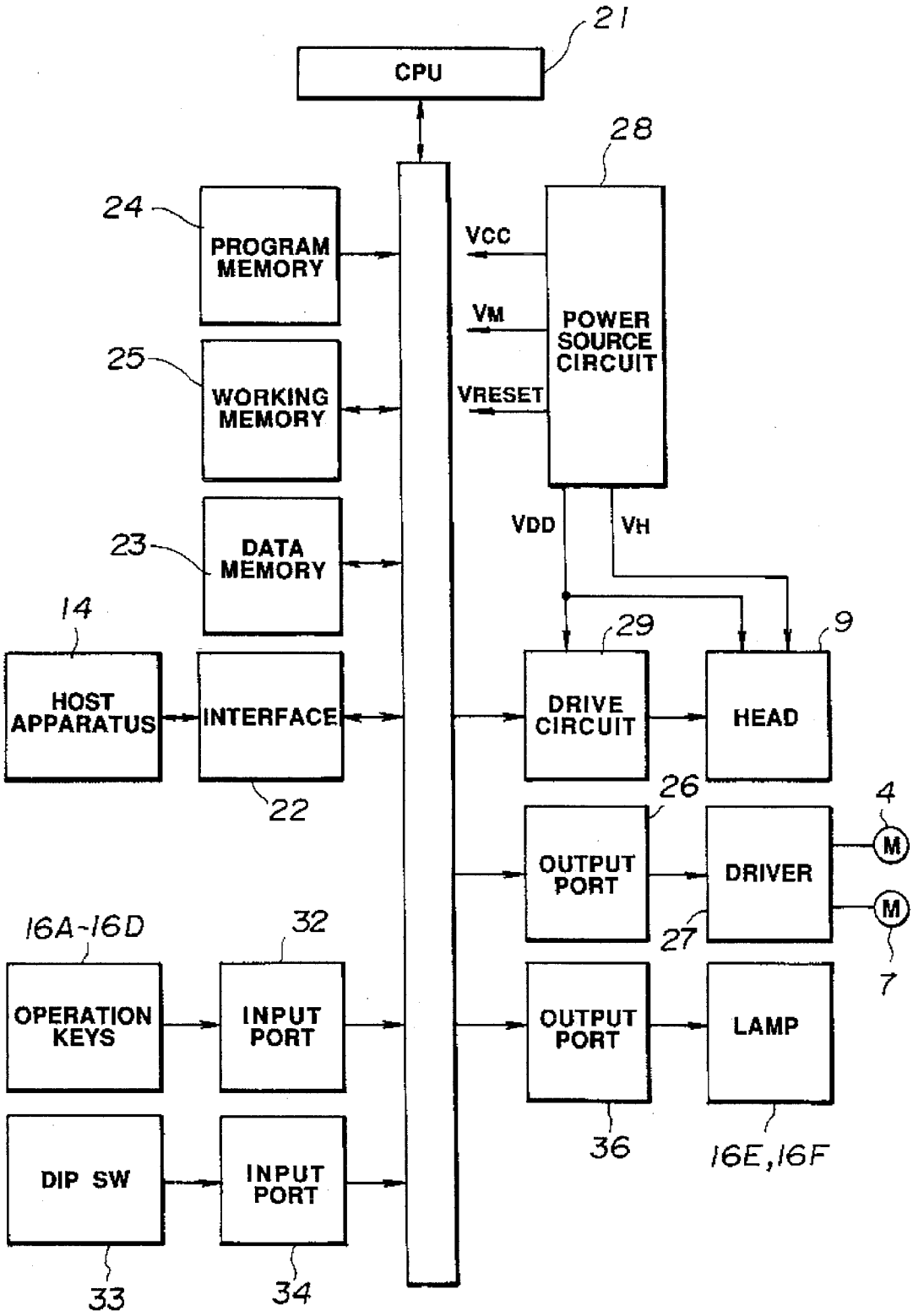
FIG. 6 is a schematic block diagram showing the structure of a control system of the color ink jet recording apparatus shown in FIG. 3.

FIG. 6 is a schematic block diagram showing the structure of a control circuit of the color ink jet recording apparatus shown in FIG. 3. Referring to FIG. 6, a CPU 21 in the form of a microprocessor is connected to a host apparatus 14 through an interface 22. The CPU 21 controls the recording according to command signals and recording information, which are input from a controller of the host apparatus 14 to a data memory 23, and program and recording command data stored in a program memory 24 in the form of a ROM and in a working memory 25 in the form of a RAM. CPU 21 controls a carriage motor 7 and a sheet feeding motor 4 through an output port 26 and a motor driver 27. CPU 21 drives a recording head 9 through a head driving circuit 29 according to recording information stored in the data memory 23. In this way, desired images can be printed on a recording medium.

Key signals from respective operation keys 16A–16D on the foregoing operation panel 160 shown in FIG. 3 are transferred to CPU 21 through an input port 32. To the warning lamps such as the alarm lamp 16E and the power source lamp 16F, control signals are transferred through an output port 36. Numeral 33 designates dip switches, for setting various operating conditions of the apparatus, situated on an underside portion of the case of the recording apparatus. Key outputs from the dip switches 33 are transferred to CPU 21 through an input port 34.

Numeral 28 designates a power source circuit which is turned on/off manually or automatically (for example, by an order from the host apparatus). From the power source circuit 28, a logic driving voltage $V_{cc}$ (for example, 5 V) for driving a control logic circuit, a motor driving voltage $V_M$ (for example, 30 V) for driving various motors, a reset voltage $V_{RESET}$, a heat voltage $V_H$ (for example, 25 V) for causing an electro-thermal converting body of an ink jet recording head to generate heat, a backup voltage $V_{DD}$ for protecting the ink jet recording head and so on are output. The heat voltage $V_H$ is applied to the ink jet recording head. The backup voltage $V_{DD}$ is applied to the head driving circuit 29 and the ink jet recording head. This ink jet recording apparatus has a system which inputs information about a kind (for example, color) of ink in a certain ink cartridge to CPU 21 through the input port 34 according to the location of the ink cartridge in the recording apparatus.

Figure 7:
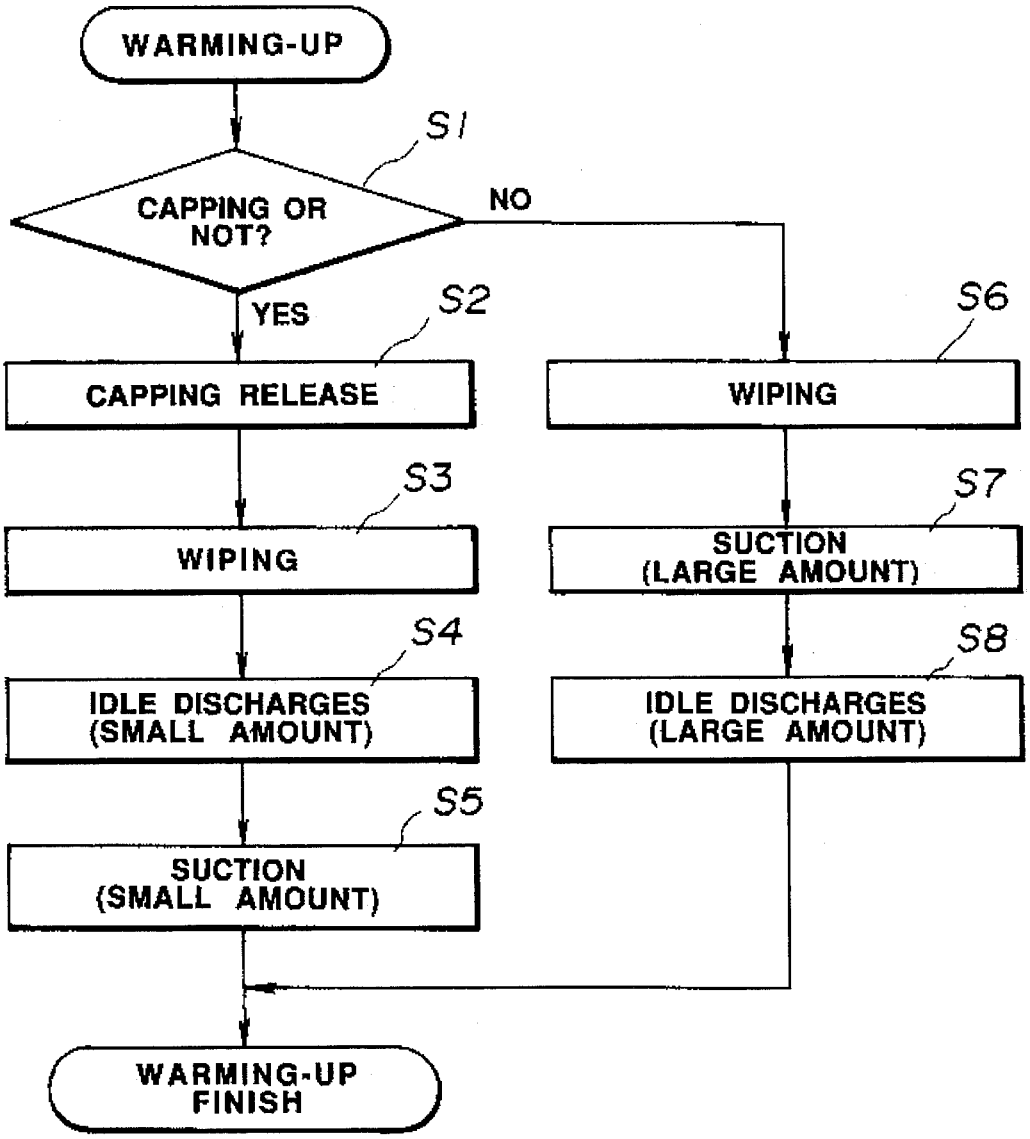
FIG. 7 is a flowchart showing a warming-up recovery operation for an ink jet recording apparatus according to one embodiment of the present invention.

FIG. 7 is a flowchart showing a warming-up recovery operation for the ink jet recording apparatus for one embodiment of the invention. This control is carried out by the recovery control circuit 98 (see FIG. 4) in CPU 21. A program for carrying out this control is memorized in the memory 99 connected to the recovery control circuit 98.

This warming-up recovery starts when the power source of the apparatus is turned on. In step S1, the capping detection portion 94 detects whether or not the cap members are capping the discharge openings of the recording heads. If the cap members are capping the discharge openings of the recording head, the flow advances to step S2, where the capping is released (that is, the cap members are moved away from the discharge openings). Then the flow advances to step S3, where the cleaning wiper member wipes the surface of the discharge openings of the ink jet recording heads. The flow advances to step S4, where pre-discharges in response to discharge signals are carried out by discharging ink into the cap members that are moved into position proximate to the discharge openings (in this step, the discharged ink volume is relatively small, for example 500 discharges). The flow advances to step S5, where capping by the cap members and subsequent suction recovery by the suction pump are carried out (in this step, the ink volume drawn from the discharge openings is relatively small, for example 0.1 g). In this way, one part of the warming-up recovery operation is completed.

On the other hand, in step S1, if the capping detection portion 94 detects that the cap members are not capping the discharge openings of the recording heads, the flow advances to step S6. In step S6, the cleaning wiper member wipes the surface of the discharge openings of the ink jet recording heads. The flow advances to step S7, where capping by the cap members and subsequent suction recovery by the suction pump are carried out (in this step, the sucked ink volume is relatively large, for example 1.0 g). The flow advances to step S8, where pre-discharges are carried out by discharging ink into the cap members in response to discharge signals (in this step, the discharged ink volume is relatively large, for example 1000 discharges). In this way, the other part of the warming-up recovery operation is completed.

As described above, if the cap members are not capping the discharge openings when the power source is turned on, an enhanced recovery operation is carried out to ensure that recovery is complete. If the cap members are in place when the power source is turned on, the recovery is carried out as usual to avoid wasting ink and time in the recovery operation.

Figure 8:
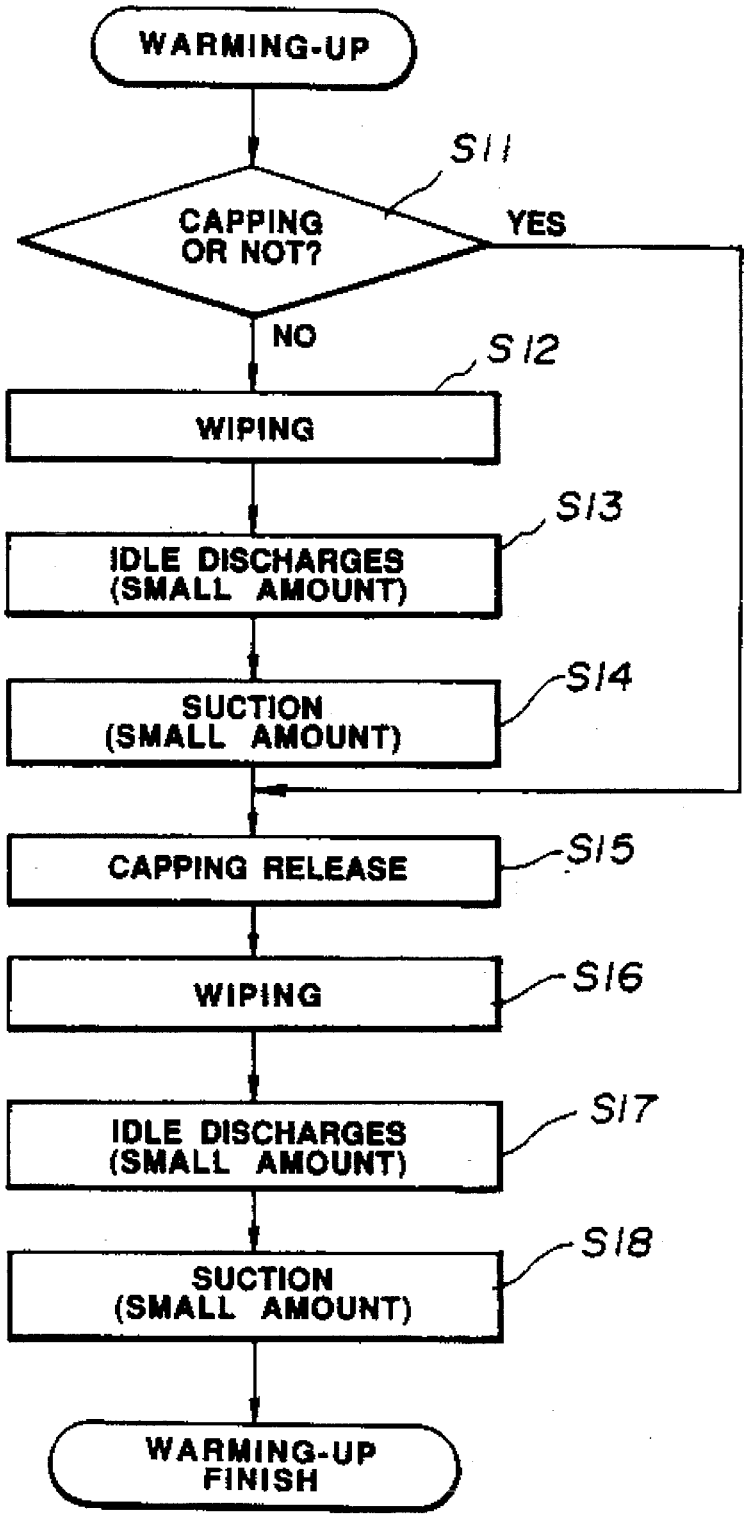
FIG. 8 is a flowchart showing a warming-up recovery operation for an ink jet recording apparatus according to another embodiment of the present invention.

FIG. 8 is a flowchart showing a warming-up recovery operation according to another embodiment. This control can be also carried out by the recovery control circuit 98. A program for carrying out this control can also be memorized in the memory 99 connected to the recovery control circuit 98.

This warming-up recovery operation starts when the power source of the apparatus is turned on. In step S11, the capping detection portion 94 detects whether or not the cap members are capping the discharge openings of the recording heads. If they do are cappings, the flow advances to step S15, where the capping is released.

But in step S11, if the capping detection portion 94 detects that the cap members are not capping the discharge openings of the recording heads, the flow advances to step S12. In step S12, the cleaning wiper member wipes the surface of the discharge openings of the ink jet recording heads. The flow advances to step S13, where pre-discharges are carried out by discharging ink into the cap members in response to discharge signals (in this step, the discharged ink volume is relatively small, for example 500 discharges). The flow advances to step S14, where capping by the cap members and subsequent suction recovery by the suction pump are carried out (in this step, the ink volume sucked from the discharge openings is relatively small, for example 0.1 g). The flow advances to step S15, where the capping is released. Then the flow advances to step S16, where the cleaning wiper member wipes the surface of the discharge openings of the ink jet recording heads. The flow advances to step S17, where pre-discharges are carried out by discharging ink into the cap members in response to discharge signals (in this step, the discharged ink volume is relatively small, for example 500 discharges). The flow advances to step S18, where capping by the cap members and the subsequent suction recovery by the suction pump are carried out (in this step, the sucked ink volume is relatively small, for example 0.1 g). In this way, the warming-up recovery operation is completed.

As described in this embodiment, the recovery if the cap members are not capping the discharge openings when the power source is turned on may include a further additional recovery process before or after the usual, basic recovery process. The further recovery process may be different from or the same as the recovery process performed when the cap members are capping the discharge openings.

Figure 9:
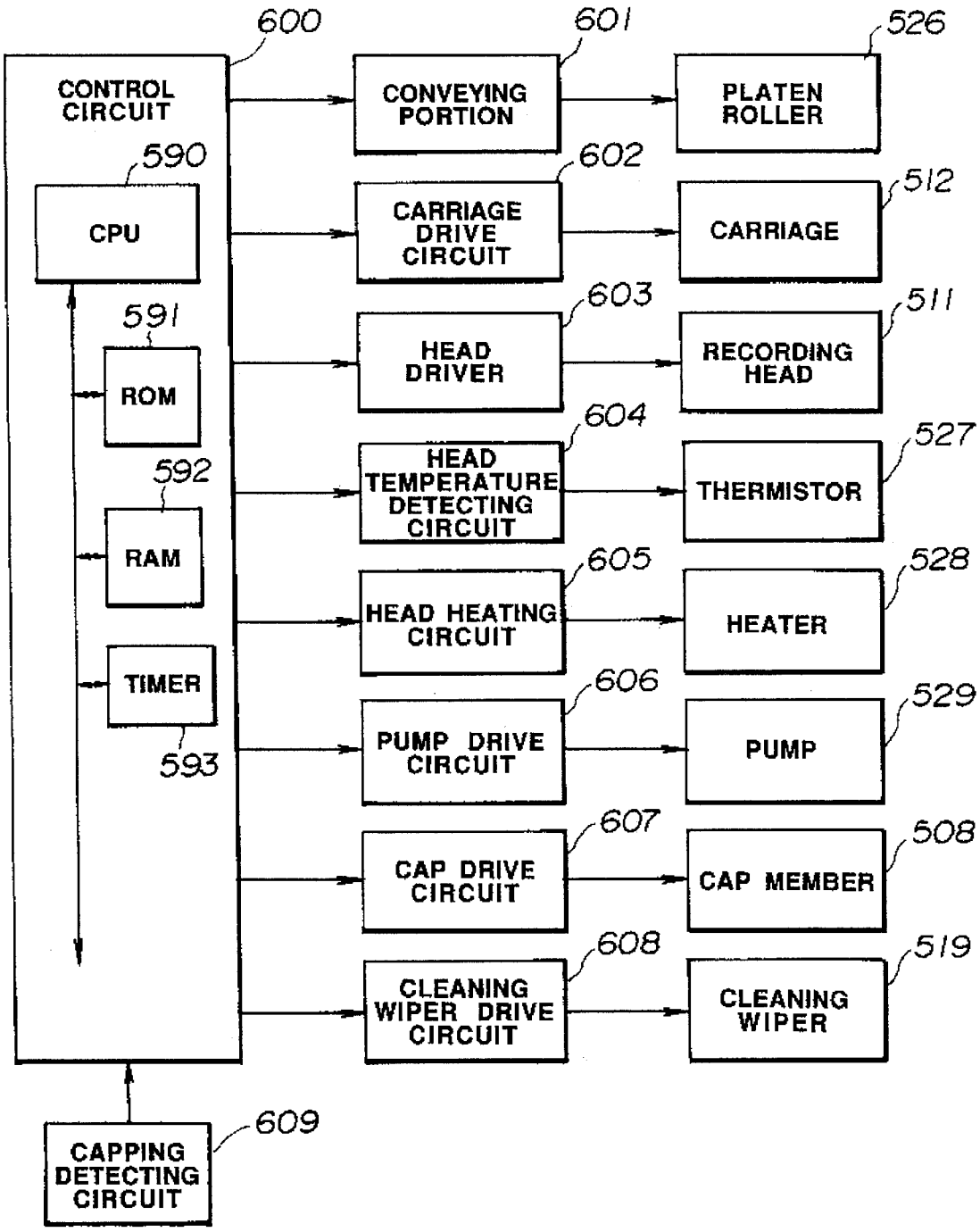
FIG. 9 is a schematic block diagram showing the structure of a control system of an ink jet recording apparatus according to another embodiment of the present invention.

FIG. 9 is a schematic block diagram showing the structure of a control system of an ink jet recording apparatus according to another embodiment. Numeral 600 designates a control circuit for controlling respective portions of the ink jet recording apparatus. This control circuit 600 includes CPU 590 for carrying out treatments mentioned later, ROM 591 with a fixed memory which contains programs and the like corresponding to the treatments, RAM 592 for carrying out operations and the like and a timer 593 for measuring different time periods.

Numeral 601 designates a conveying portion for conveying a recording medium by a platen roller 526 in the sub-scanning direction. Numeral 602 designates a carriage drive circuit for driving a carriage 512. Numeral 603 designates a head driver for driving electro-thermal converting bodies of a recording head 511. Numeral 604 designates a temperature detecting circuit for detecting a temperature of the recording head according to the output from a thermistor 527 on the recording head 511. Numeral 605 designates a heating circuit for controlling a heater 528 such as "POSISTOR" (manufactured by MURATA MANUFACTURING CO., LTD.) on the recording head 511, in the recording head 511 or in the vicinity of the recording head 511, to maintain and control its temperature. If electro-thermal converting bodies are used in the recording head 511 as energy generating bodies which generate energy to be utilized to discharge ink, these electro-thermal converting bodies can be used as the heater 528. Numeral 606 designates a pump drive circuit for driving a pump 529. Numeral 607 designates a cap drive circuit for making a cap member 508 move to cover and to uncover discharge openings of the recording head 511. Numeral 608 designates a cleaning wiper drive circuit for making a cleaning wiper member 519 contact with the discharge openings of the recording head 511. Numeral 609 designates a capping detecting circuit for detecting the state of the cap member 508.

Figure 10:
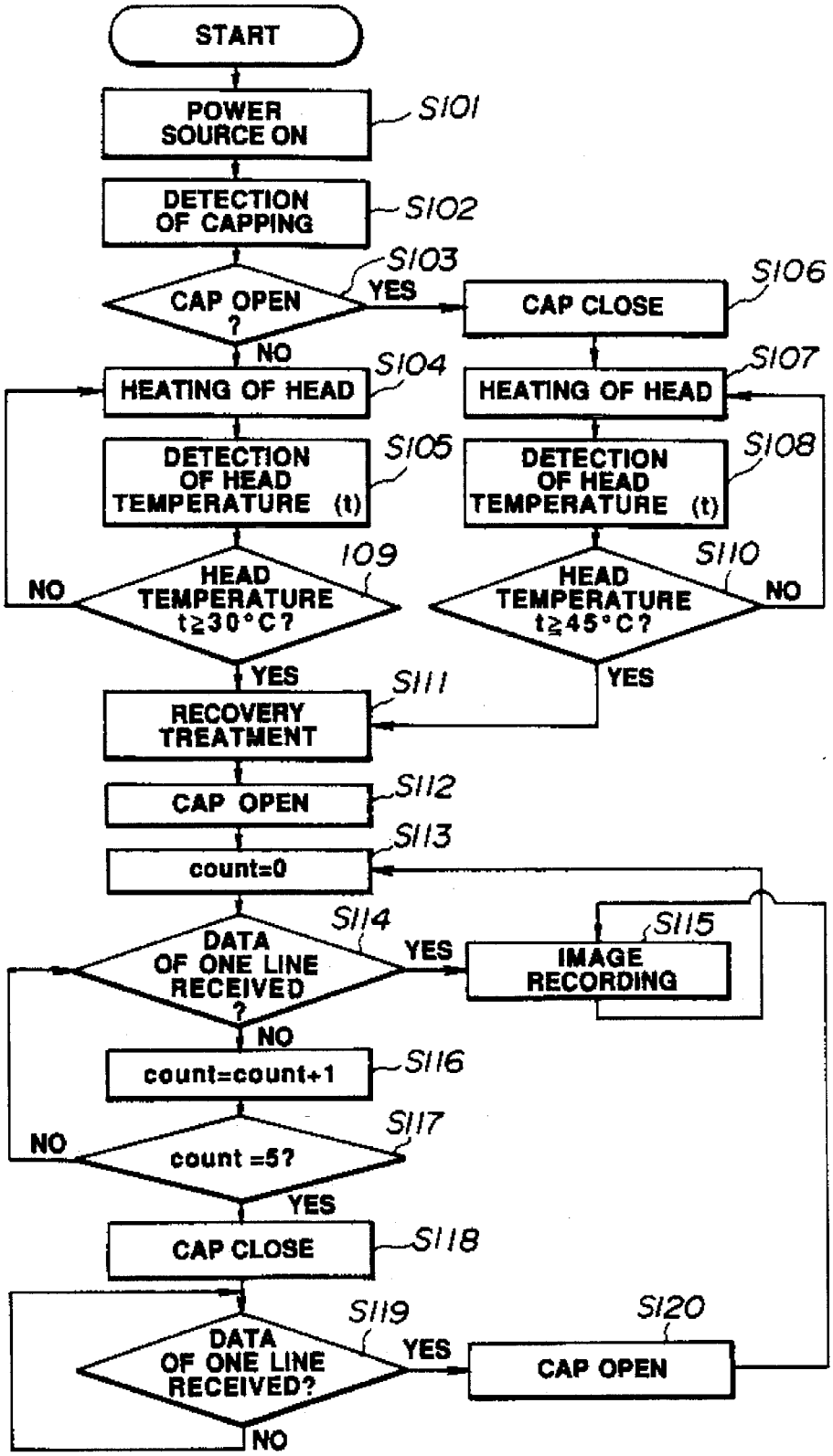
FIG. 10 is a flowchart showing a warming-up recovery operation for an ink jet recording apparatus according to another embodiment of the present invention.

FIG. 10 is a flowchart showing a warming-up recovery operation according to another embodiment of the invention. The power source of the apparatus is turned on in step S101, then in step S102 the capping detecting circuit 609 detects whether or not the cap member 508 is capping the discharge openings of the recording head. If the capping detecting circuit 609 detects that the cap member 508 is not capping the discharge openings of the recording head in step S103, the cap drive circuit 607 drives the cap member 508 to cap the discharge openings of the recording head in step S106. Then the flow advances to step S107, and the recording head and ink in the ink passage of the recording head are heated by the heater 528 on the recording head. Then the temperature of the recording head is detected by the thermistor 527 in step S108. If the temperature of the recording head is less than 45° C. in step S110, steps S107 to S110 are repeated in order. If the temperature of the recording head is at least 45° C. in step S110, the flow advances to step S111.

If the capping detecting circuit 609 detects that the cap member 508 is capping the discharge openings of the recording head in step S103, the recording head is heated by the heater 528 on the recording head in step S104. Then the temperature of the recording head is detected by the thermistor 527 in step S105. Until the temperature of the recording head becomes at least 30° C. in step S109, steps S104 to S109 are repeated in order. If the temperature of the recording head is at least 30° C. in step S109, the flow advances to step S111, in which the recovery treatment is carried out.

In this embodiment, the recovery treatment involves suction from the discharge openings of viscous ink that has an adverse influence on discharging using a suction tube connected to the suction pump 529 while the discharge openings are capped by the cap member 508. The recovery treatment can be carried out completely because the effectiveness of suction is enhanced by increasing the temperature of the ink if the discharge openings are not capped by the cap member 508 when the power source is turned on.

After the recovery treatment, the cap member is released in step S112. This is a stand-by condition to wait for recording signals. The counter is reset to zero in step S113 to measure a non-recording period during which the discharge openings are not capped by the cap member 508. Then in step S114 it is judged whether data of one line have been received or not.

The ink jet recording head used in this embodiment can carry out recording at the density of 360 dots per one inch (360 dpi) and has 64 discharge openings. Therefore if image data of 64 rasters are received, scan-recording is carried out. That is to say, if image data of 64 rasters are received in step S114, the image recording of one scanning is carried out in step S115.

If it is judged that image data of 64 rasters are not received in step S114, one is added to the counter in step S116. If the value of the counter is less than five in step S117, the flow returns to step S114. If the value of the counter is five in step S117, the discharge openings are capped by the cap member 508 in step S118. Step S119 waits for the data for one line of recording, and when it is received, the cap member is released in step S120 and image recording is carried out in step S115. In this embodiment, one cycle of steps S114, S116, and S117 is carried once per second. Accordingly, if the value of the counter indicates five, that is, if the non-recording condition continues for five seconds, the discharge openings are capped by the cap member 508 in step S118.

Figure 11:
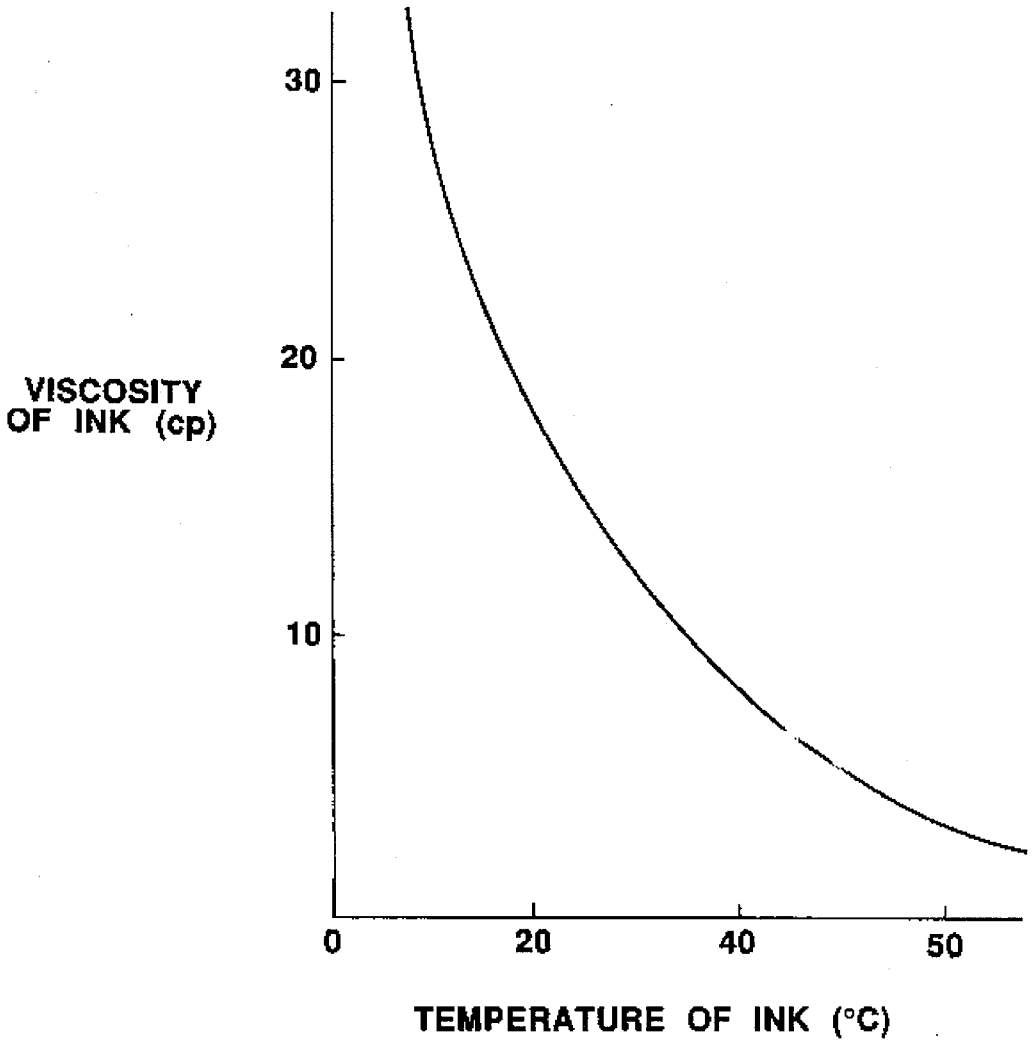
FIG. 11 is a graph showing a relationship between the temperature and viscosity of an ink suitable for use in an ink jet recording apparatus of the present invention.

FIG. 11 is a graph showing a relationship between the temperature and viscosity of ink, from which it is clear that the higher the temperature of the ink, the lower its viscosity. If the cap 508 is left not covering the discharge openings, a usual recovery operation may not be sufficient to remove ink in the ink passages of the recording head, because the viscosity of the ink is higher than usual through evaporation of the ink solvent (for example, water). However, ink can be drawn smoothly and certainly from the discharge openings by increasing the temperature of the recording head, and the ink in the ink passages, to decrease the ink viscosity.

Now another embodiment of the present invention will be described in detail. In this embodiment, not only the temperature of the recording head but also the nature of the recovery treatment are changed according to the capping situation when the power source is turned on.

Figure 12:
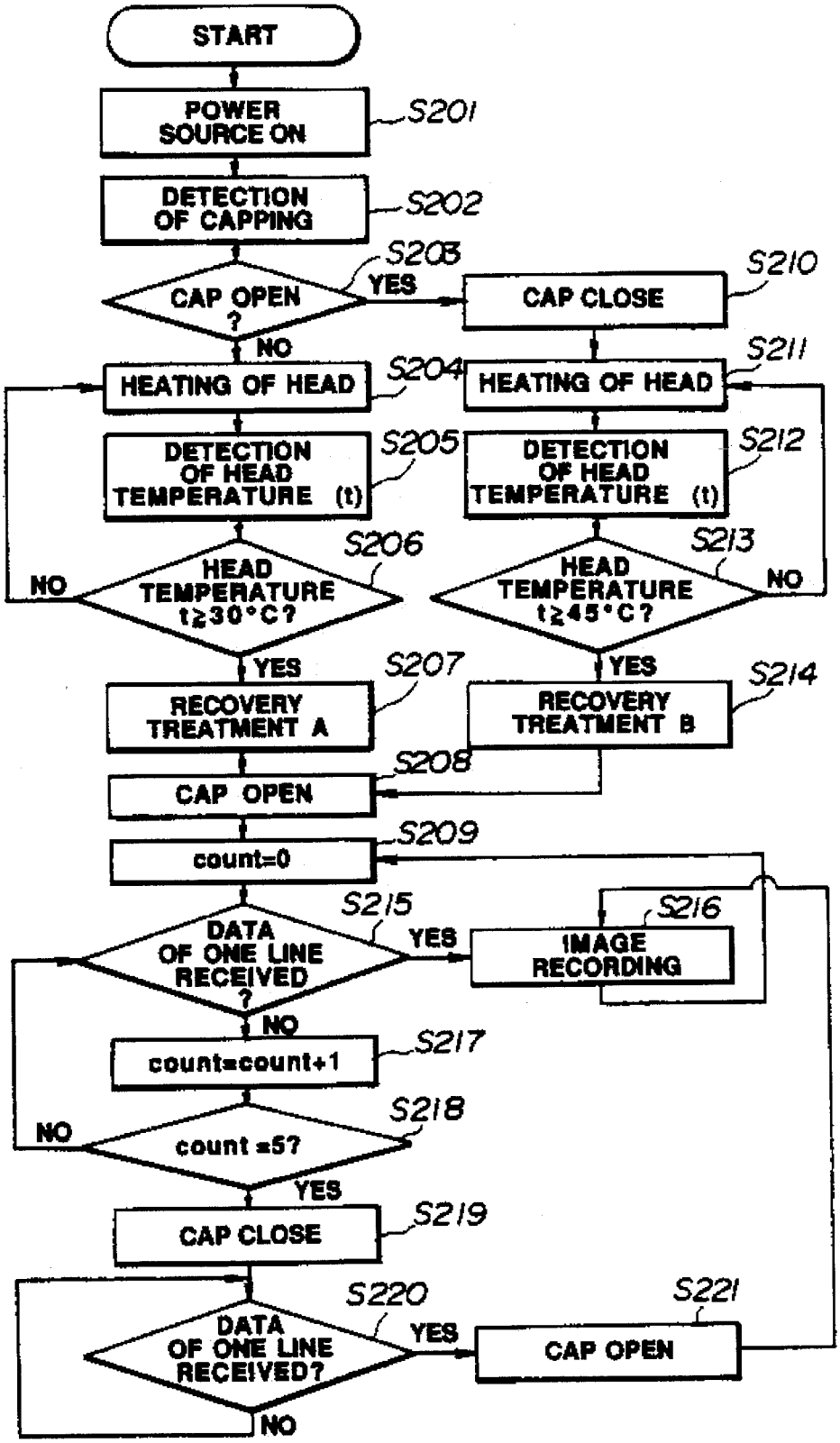
FIG. 12 is a flowchart showing a warming-up recovery operation for an ink jet recording apparatus according to another embodiment of the present invention.

FIG. 12 is a flowchart showing a warming-up recovery operation according to this embodiment. The power source of the apparatus is turned on in step S201, then in step S202 the capping detecting circuit 609 detects whether or not the cap member 508 is capping the discharge openings of the recording head. If the capping detecting circuit 609 detects that the cap member 508 is not capping the discharge openings of the recording head in step S203, the cap drive circuit 607 drives the cap member 508 to cap the discharge openings of the recording head in step S210. Then the flow advances to step S211, in which the recording head and ink in the ink passages of the recording head are heated by the heater 528. Then the temperature of the recording head is detected by the thermistor 527 in step S212. If the temperature of the recording head is less than 45° C. in step S213, steps from S211 to S213 are repeated in order. If the temperature of the recording head is at least 45° C. in step S213, the flow advances to step S214, in which a recovery treatment B, described below, is carried out.

If the capping detecting circuit 609 detects that the cap member 508 is capping the discharge openings of the recording head in step S203, the recording head is heated by the heater 528 in step S204. Then the temperature of the recording head is detected by the thermistor 527 in step S205. Until the temperature of the recording head becomes at least 30° C. in step S206, steps from S204 to S206 are repeated in order. If the temperature of the recording head is at least 30° C. in step S206, the flow advances to step S207, in which the recovery treatment A, described below, is carried out.

After the recovery treatment, the cap member is released in step S208. This is a stand-by condition to wait for recording signals. A detailed description of steps including and after S209 is omitted because they are similar to the corresponding steps including and after S113 in FIG. 10.

Figure 13:
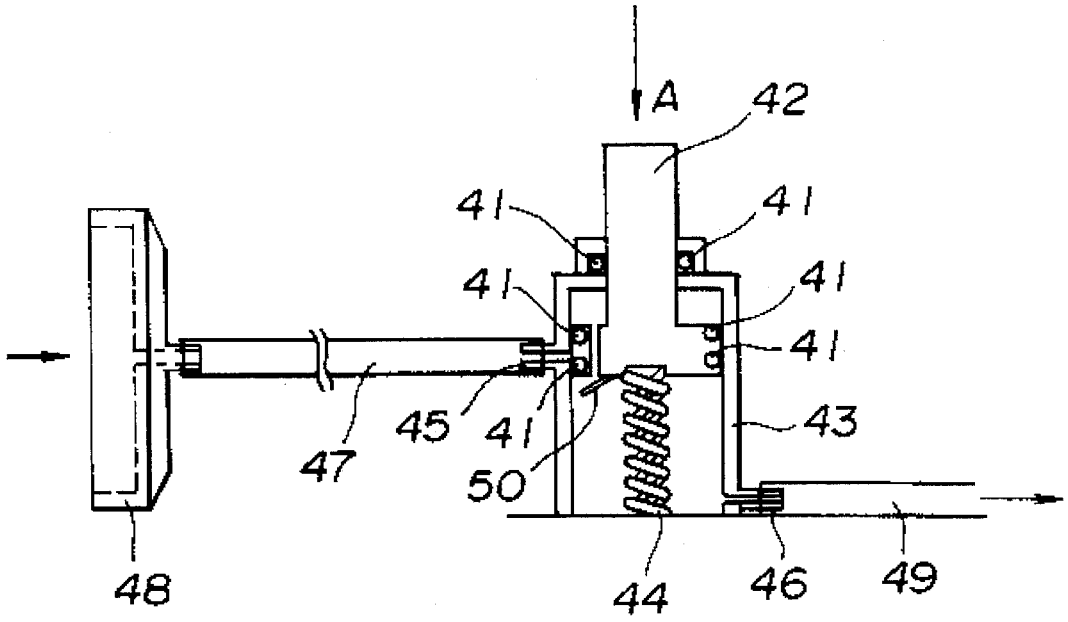
FIG. 13 is a schematic cross sectional view showing an ink suction pump of a recovery apparatus usable in the ink jet recording apparatus of the present invention.

FIG. 13 is a schematic vertical cross sectional view showing an ink suction pump of the recovery apparatus usable in the ink jet recording apparatus of embodiments of the present invention. In FIG. 13, numeral 41 is an O-ring that acts as a shield, numeral 42 is a piston, numeral 43 is an outside wall of the pump, numeral 44 is a spring for restoring the pushed piston 42, numeral 45 is a suction opening, numeral 46 is an exhaust opening, numeral 47 is a suction tube, numeral 48 is a cap member, numeral 49 is an exhaust tube, and numeral 50 is a valve. Ink can be sucked from discharge openings of the recording head through the cap member 48 capping the discharge openings by pushing the piston 42 in the direction of an arrow A by the drive circuit which is not illustrated in FIG. 13.

Figure 14:
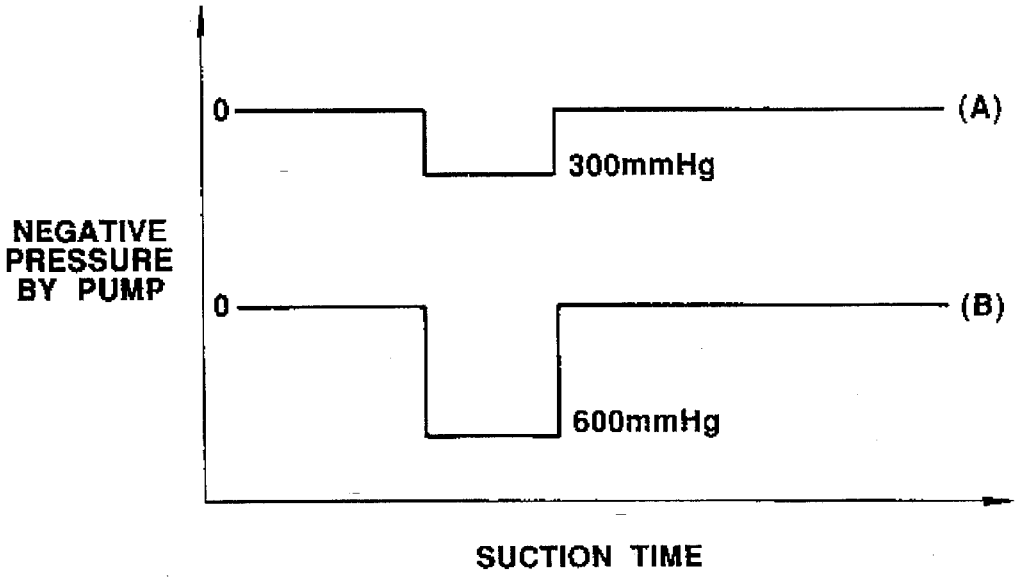
FIG. 14 is a graph showing a pressure generated in the cap member shown in FIG. 13 by the suction pump shown in FIG. 13.

FIG. 14 is a graph showing a pressure which is generated in the cap member by the suction pump. In FIG. 14, line A designates pressure change in the cap in the recovery treatment A in step S207 of FIG. 12 and line B designates the pressure change in the cap in the recovery treatment B in step S214 of FIG. 12. The suction in the recovery treatment A carried out at 300 mmHg, while the suction in the recovery treatment B is carried out at 600 mmHg. In this way, the suction in the recovery treatment B is stronger as compared to the suction in the recovery treatment A. In the recovery treatments A and B, the negative pressure generated during the suction can be changed by changing the stroke volume of the piston 42 of the suction pump in FIG. 13.

If the cap 508 is left uncapped the discharge openings, the ink becomes more viscous through evaporation of the ink solvent, as noted above. Viscous ink which can adversely affect on discharging can be sucked smoothly and certainly from the discharge openings by the recovery treatment B with the strong suction as well as by increasing the temperature of the recording head and ink in the ink passages of the recording head to decrease the viscosity of ink.

Figure 15:
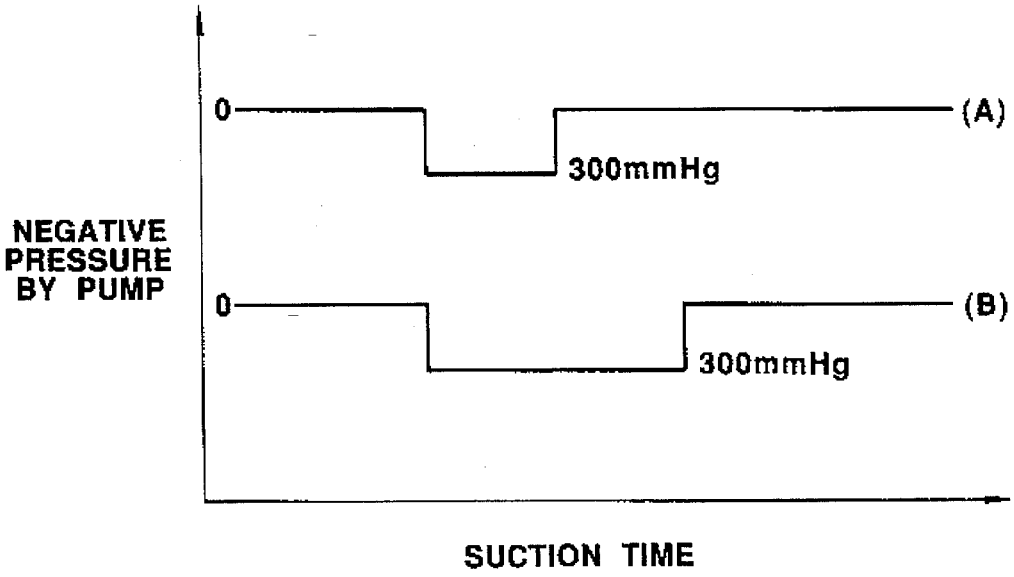
FIG. 15 is a graph showing a pressure which generated in a cap member by a suction pump in another embodiment of the present invention.

FIG. 15 is a graph showing a pressure which is generated in the cap member by the suction pump in reference to another embodiment. In this embodiment, the recovery treatment B is enhanced by lengthening the time during which the piston 42 of the suction pump is pushed down to lengthen the time during which negative pressure is applied in the recovery treatment B as compared with the recovery treatment A. An effect similar to that of the embodiment mentioned above can thus be obtained in this embodiment.

Figure 16:
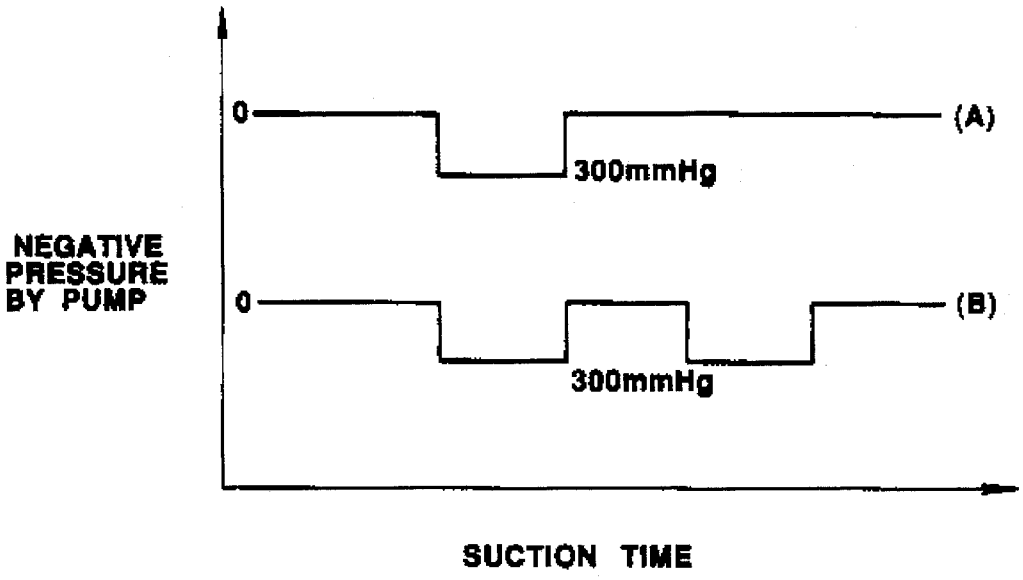
FIG. 16 is a graph showing a pressure generated in a cap member by a suction pump in another embodiment of the present invention.

FIG. 16 is a graph showing a pressure which is generated in the cap member by the suction pump in reference to another embodiment. In this embodiment, the recovery treatment B is enhanced as compared to recovery treatment A by increasing number of times the piston 42 is pushed down to increase the number of times negative pressure is generated in the recovery treatment B compared with the recovery treatment A. An effect similar to that of the embodiment mentioned above can thus be obtained in this embodiment.

Now another embodiment of the present invention will be described in detail. In this embodiment, not only the temperature of the recording head but also the contents of the recovery treatment are changed according to not only the capping situation when the power source is turned on but also the time for which the discharge openings have been left uncapped by the cap member.

Figure 17:
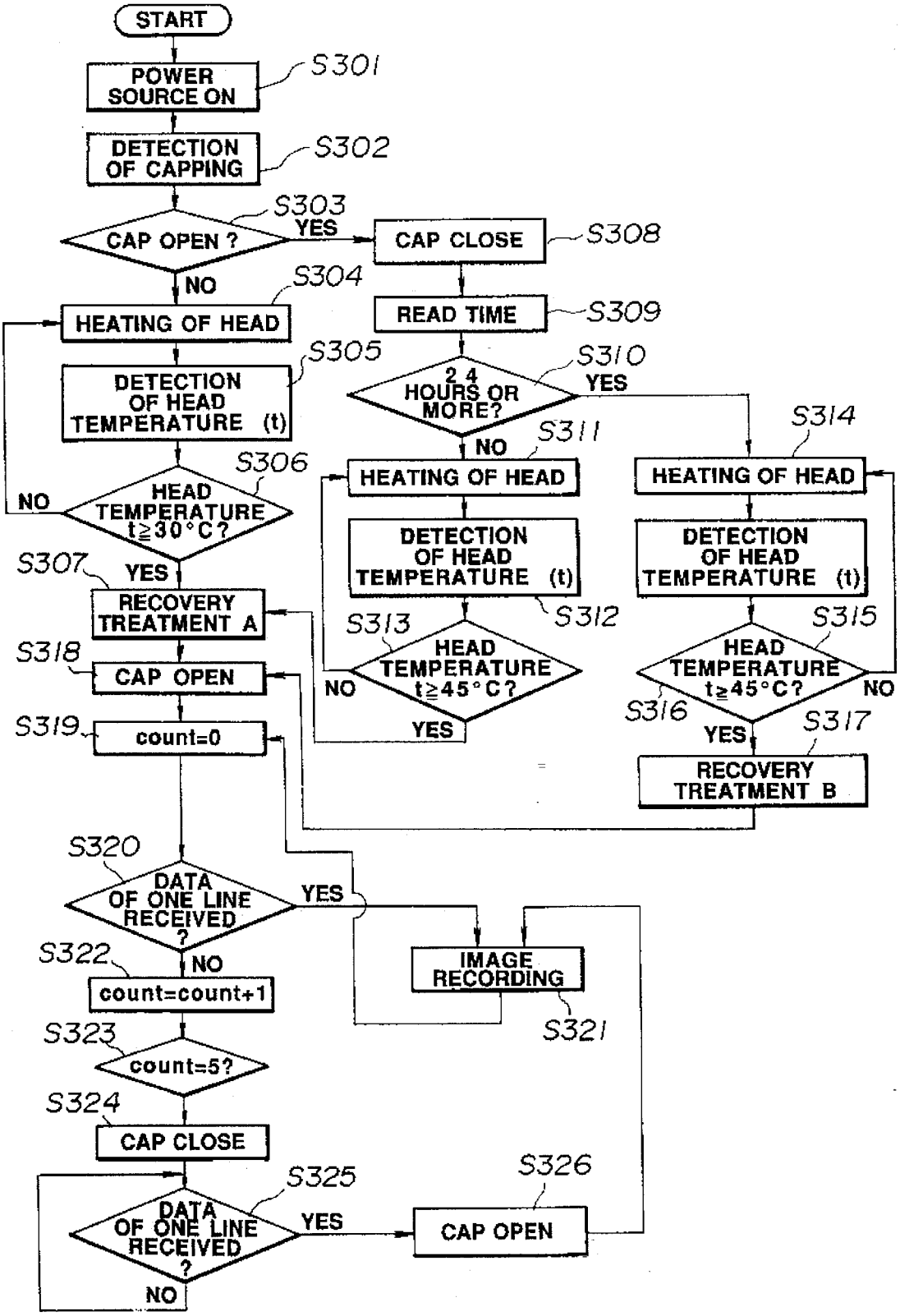
FIG. 17 is a flowchart showing a warming-up recovery operation for an ink jet recording apparatus according to another embodiment of the present invention.

FIG. 17 is a flowchart showing a warming-up recovery operation according to this embodiment. The power source of the apparatus is turned on in step S301, then in step S302 the capping detecting circuit 609 detects whether or not the cap member 508 is capping the discharge openings.

If the capping detecting circuit 609 detects that the cap member 508 is capping the discharge openings of the recording head in step S303, the recording head is heated by the heater 528 in step S304. Then the temperature of the recording head is detected by the thermistor 527 in step S305. Until the temperature of the recording head becomes at least than 30° C. in step S306, steps from S304 to S306 are repeated in order. If the temperature of the recording head is at least 30° C. in step S306, the flow advances to step S307, in which the recovery treatment A is carried out.

If the capping detecting circuit 609 detects that the cap member 508 is not capping the discharge openings head in step S303, the cap drive circuit 607 drives the cap member 508 to cap the discharge openings of the recording head in step S308. Then the value of the timer 593 set in the apparatus is read in step S309. The timer 593 begins to operate when the power source of the apparatus is turned off, and stops operating when the power source is turned on. The power source of the timer is a storage battery, which is charged while the power source of the apparatus is on.

If the time measured by the timer is less than 24 hours in step S310, the flow advances to step S311, the recording head and ink in the ink passages of the recording head are heated by the heater 528. Then the temperature of the recording head is detected by the thermistor 527 in step S312. If the temperature of the recording head is less than 45° C. in step S313, steps from S311 to S313 are repeated in order. If the temperature of the recording head is at least 45° C. in step S313, the flow advances to step S314, in which the recovery treatment A is carried out.

If the time measured by the timer is 24 hours or more in step S310, the flow advances to step S314, the recording head and ink in the ink passages of the recording head are heated by the heater 528. Then the temperature of the recording head is detected by the thermistor 527 in step S315. If the temperature of the recording head is less than 45° C. in step S316, steps from S314 to S316 are repeated in order. If the temperature of the recording head is at least 45° C. in step S316, the flow advances to step S317, in which the recovery treatment B is carried out.

In this embodiment, the recovery treatments A and B are the same as the respective recovery treatments A and B described above in FIGS. 14 to 16. After the recovery treatment, the cap member is released in step S318. This is a stand-by condition to wait for recording signals. A detailed description of steps including and after S319 is omitted because they are similar to steps including and after S113 in FIG. 10 of the embodiment mentioned above and steps including and after S209 in FIG. 12 of the embodiment mentioned above. Similar or further better effect as compared to the embodiments mentioned above can be obtained in this embodiment.

In the embodiments shown in FIGS. 7 and 8, wiping is carried out before idle discharges if the cap member is not capping the discharge openings when the power source of the ink jet apparatus is turned on. Therefore, idle discharges can be carried out effectively because extraneous matter such as viscous ink that can accumulate around the discharge opening is removed from the discharge surface by wiping. Especially in the embodiment shown in FIG. 7, suction as well as wiping is carried out before idle discharges. Accordingly, idle discharges can be carried out even more effectively because any extraneous matter in the discharge openings that can interfere with ink discharge is removed before the idle discharges are performed.

In the embodiments shown in FIGS. 10, 12 and 17, heating of the ink jet head is carried out before the recovery treatment if the cap member is not capping the discharge openings when the power source of the ink jet apparatus is turned on. Therefore, the recovery treatment can be carried out effectively because any viscous ink accumulated in and around the discharge openings can be removed easily because its viscosity is decreased. Especially in the embodiments shown in FIGS. 12 and 17, the recovery treatment as well as the amount of heating of the ink jet head is changed according to the situation of the ink jet apparatus, such as the capping situation when the power source of the ink jet apparatus is turned on. Accordingly, similar or better effects than those of the foregoing embodiments can be obtained.

As another embodiment, the steps S104 to S109 in FIG. 10 are added between step S1 and S2 in FIG. 7, and the steps S106 to S110 in FIG. 10 are added between step S1 and S6 in FIG. 7 (In step S6 in such an embodiment, capping would be released before wiping). Similar or further better effects as compared to the embodiment described in FIG. 7 can be obtained in this embodiment.

As another embodiment, the steps S104 to S109 in FIG. 10 are added when the flow skips from step S11 to S15 in FIG. 8, and the steps S106 to S110 in FIG. 10 are added between step S11 and S12 in FIG. 8 (In step S12 in such an embodiment, capping would be released before wiping). Similar or further better effects as compared to the embodiment mentioned in FIG. 8 can be obtained in this embodiment.

The present invention is particularly useful in an ink jet recording head and recording apparatus of the type which discharges an ink by making use of thermal energy. This is because high density of picture elements and high resolution of recording are possible.

The typical structure and the operational principle of such an apparatus are disclosed in U.S. Pat. Nos. 4,723,129 and 4,740,796. The principle is applicable to a so-called on-demand type recording system and a continuous type recording system. Particularly, however, it is suitable for the on-demand type because the principle is such that a least one driving signal is applied to an electrothermal transducer disposed on a liquid (ink) retaining sheet or liquid passage, the drawing signal being enough to provide such a quick temperature rise beyond a departure from nucleation boiling point, by which the thermal energy is provided by the electrothermal transducer to produce film boiling on the heating portion of the recording head, whereby a bubble can be formed in the liquid (ink) corresponding to each of the driving signals. By the development and collapse of the bubble, the liquid (ink) is ejected through an ejection outlet to produce at least one droplet. The driving signal is preferably in the form of a pulse, because the development and collapse of the bubble can be effected instantaneously, and therefore, the liquid (ink) is ejected with quick response. The driving signal in the form of the pulse is preferably such as that disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion in addition to the structure of the combination of the ejection outlet, liquid passage and the electro-thermal transducer as disclosed in the above-mentioned patents. In addition, the present invention is applicable to the structure disclosed in Japanese Patent Laid-Open (Kokai) No. 59-123670 wherein a common slit is used as the ejection outlet for plural electrothermal transducers, and to the structure disclosed in Japanese Patent Laid-Open (Kokai) No. 59-138461 wherein an opening for absorbing a pressure wave of the thermal energy is formed corresponding to the ejecting portion. This is because the present invention is effective to perform the recording operation with certainty and at high efficiency irrespective of the type of the recording head.

The present invention is effectively applicable to a so-called full-line type recording head having a length corresponding to the maximum recording width. Such a recording head may comprise a single recording head or plural recording heads combined to cover the entire width.

In addition, the present invention is applicable to a serial type recording head wherein the recording head is fixed on the main assembly, to a replaceable chip type recording head which is connected electrically with the main apparatus and can be supplied with the ink by being mounted in the main assembly, or to a cartridge type recording head having an integral ink container.

The provision of the recovery means and the auxiliary means for the preliminary operation are preferable, because they can further stabilize the effect of the present invention. As for such means, there are capping means for the recording head, cleaning means therefor, pressing or suction means, preliminary heating means by the ejection electrothermal transducer or by a combination of the ejection electrothermal transducer and an additional heating element and means for preliminary ejection not for the recording operation, which can stabilize the recording operation.

As regards the kinds of the recording head, it may be a single head corresponding to a single color ink, or may be plural heads corresponding to a plurality of ink materials having different recording colors or densities. The present invention is effectively applicable to an apparatus having at least one of a monochromatic mode for recording mainly with black ink material and a multi-color mode for recording with a mixture of the colors and may be an integrally formed recording unit or a combination of plural recording heads.

Furthermore, in the foregoing embodiments, the ink material has been liquid. It may be, however, an ink material that solidifies at or below room temperature and liquefies at room temperature. Since in the ink jet recording system the ink is controlled within a temperature range not lower than 30° C. and not higher that 70° C. to stabilize the viscosity of the ink to ensure stabilized ejection, in usual recording apparatuses of this type, the ink is such that it is liquid within the temperature range when the recording signal is applied. In addition, a temperature rise due to the thermal energy may be positively prevented by utilizing the thermal energy for the state change of the ink from the solid state to the liquid state, or the ink material solidifying when it is left unused may be used to prevent the evaporation of the ink. In either case, upon the application of the recording signal producing thermal energy, the ink may be liquefied, and the liquefied ink may be ejected. The ink may start to solidify at the time it reaches the recording medium. The present invention is applicable to such an ink material as is liquefied by the application of the thermal energy. Such an ink material may be retained as a liquid or solid material through holes or recesses formed in a porous sheet as disclosed in Japanese Patent Laid-Open (Kokai) Nos. 54-56847 and 60-71260. The sheet is disposed facing the electro-thermal transducers. The most effective system for the ink materials described above is the film boiling system.

The ink jet recording apparatus may be used as an output terminal of an information processing apparatus such as computer or the like, a copying apparatus combined with an image reader or the like, or a facsimile machine having information sending and receiving functions.

Figure 18:
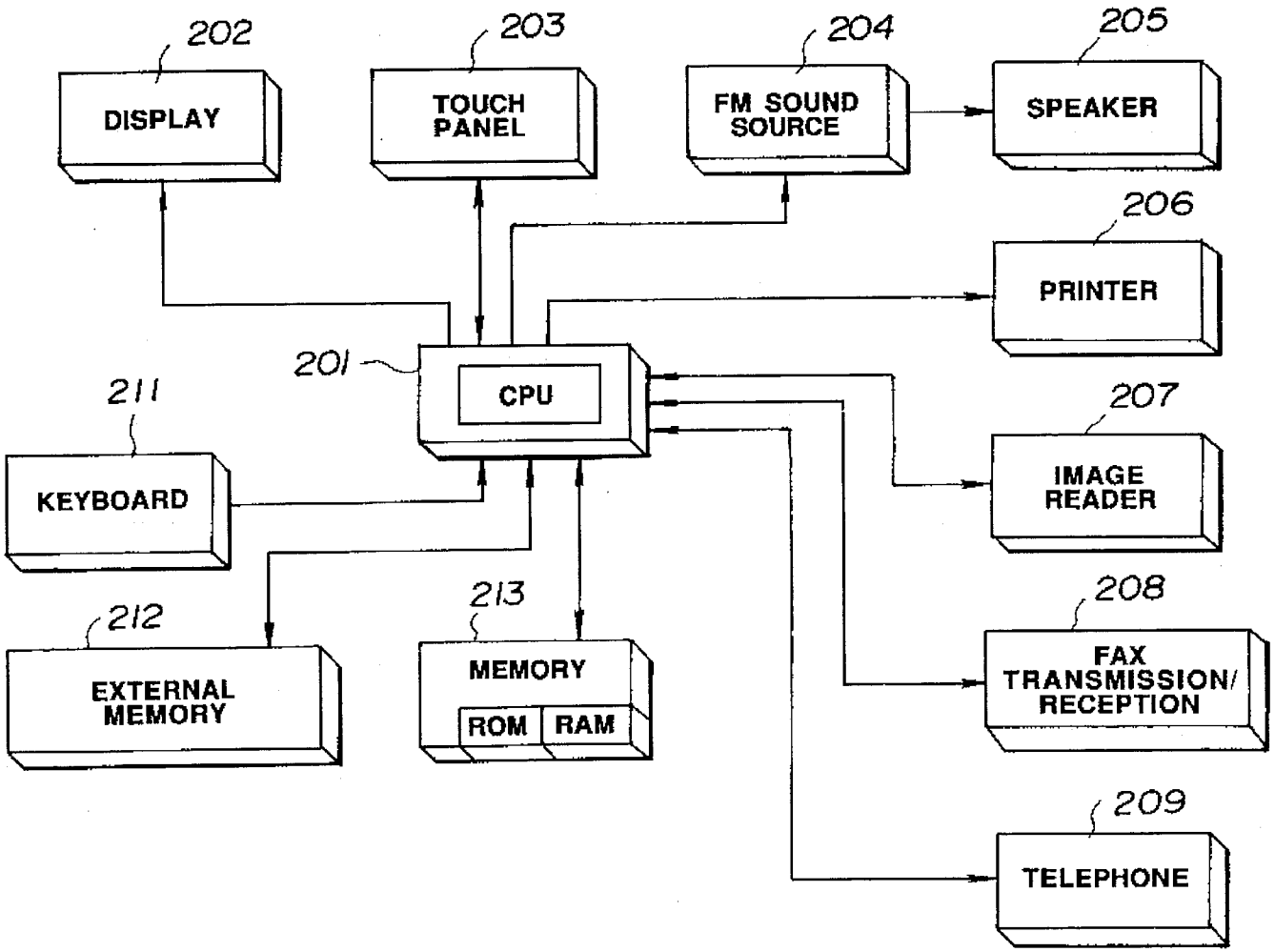
FIG. 18 is a schematic block diagram showing the construction of an information processor usable in the present invention.

FIG. 18 is a block diagram schematically illustrating the construction of an information processor, having the functions of a word processor, a personal computer, a facsimile machine and a copying machine, to which the recording apparatus of the present invention can be applied. A block 201 represents a control unit which has overall control of the information processor, and which has a CPU constituted of a microprocessor or the like, and various I/O ports. The control unit 201 controls other components by outputting control signals, data signals and the like to the other components and receiving controls signals and data signals therefrom. A block 202 represents a display unit having a display screen on which various menus, document information and image data read with an image reader 207 are displayed. A block 203 represents a transparent pressure-sensitive touch panel provided over the display unit 202. Data item inputting and coordinate position inputting through the display unit 202 can be performed by pressing a surface of the touch panel 203 with a finger or the like.

A block 204 represents a frequency modulation (FM) sound source. Music information prepared with a music editor is stored as digital data in a memory 213 or an external memory 212 and is read therefrom to be FM-modulated by the FM sound source 204. An electrical signal from the FM sound source 204 is converted into an audible sound by a speaker 205. A printer unit 206 is an output terminal in accordance with the present invention.

A block 207 represents an image reader unit for photoelectrically reading an original and inputting read original data. The image reader unit 207 is provided at an intermediate portion of an original transport path. The image reader unit 207 reads facsimile originals, originals to be copied and other various kinds of originals. A block 208 represents a facsimile transmission/reception unit which serves for facsimile transmission of original data read by the image reader unit 207 and which receives a transmitted facsimile signal and decodes the receives signal. Facsimile transmission/reception unit 208 functions as an interface with an external terminal. A block 209 represents a telephone unit having various telephone functions such as an ordinary telephone function and a message recording function. A block 210 represents a memory unit including a ROM for storing a system program, a manager program, application programs, character fonts, dictionaries, and other categories of data, and a RAM for storing application programs, character information, video data and other categories of data loaded from the external memory 212.

A block 211 represents a keyboard unit for inputting document information and various kinds of commands. A block 212 represents an external memory unit using a floppy disk, hard disk or the like as a memory medium. Character information, music or sound information, user's application programs, and the like are stored in the external memory unit 212.

Figure 19:
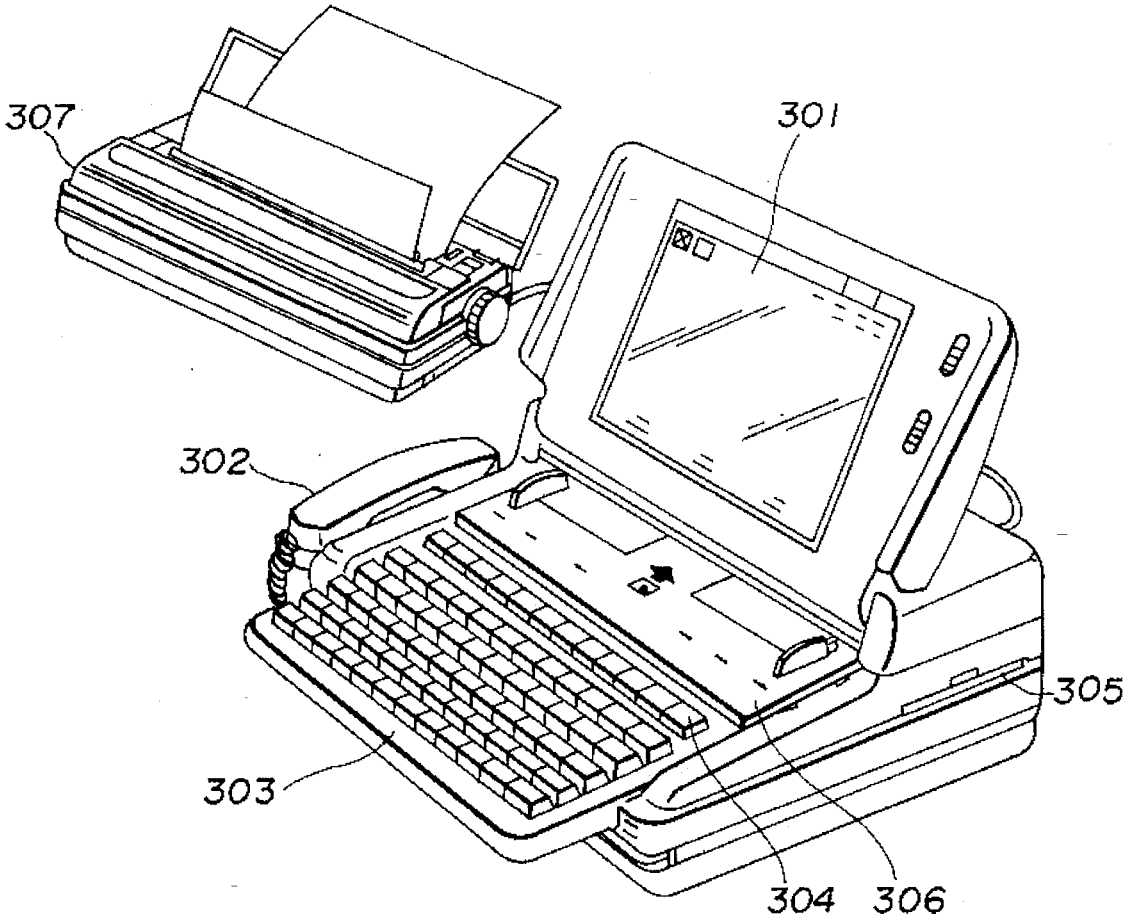
FIG. 19 is a schematic perspective view of an information processor incorporating the construction shown in FIG. 18.

FIG. 19 is a schematic perspective view showing the information processor shown in FIG. 18. On a flat display panel 301 using a liquid crystal or the like, various menus, drawing information, document information and other categories of information are displayed. The touch panel is placed on the display panel 301. Coordinate inputting and item designation inputting can be performed by pressing the surface of the touch panel. A handset 302 is used when information processor functions as a telephone.

The keyboard 303 is detachably connected to the main body through a code and is capable of inputting various kinds of character information and various processor. At the time of facsimile reception, received information is recorded by an ink jet printer 307 in accordance with the present invention.

Figure 20:
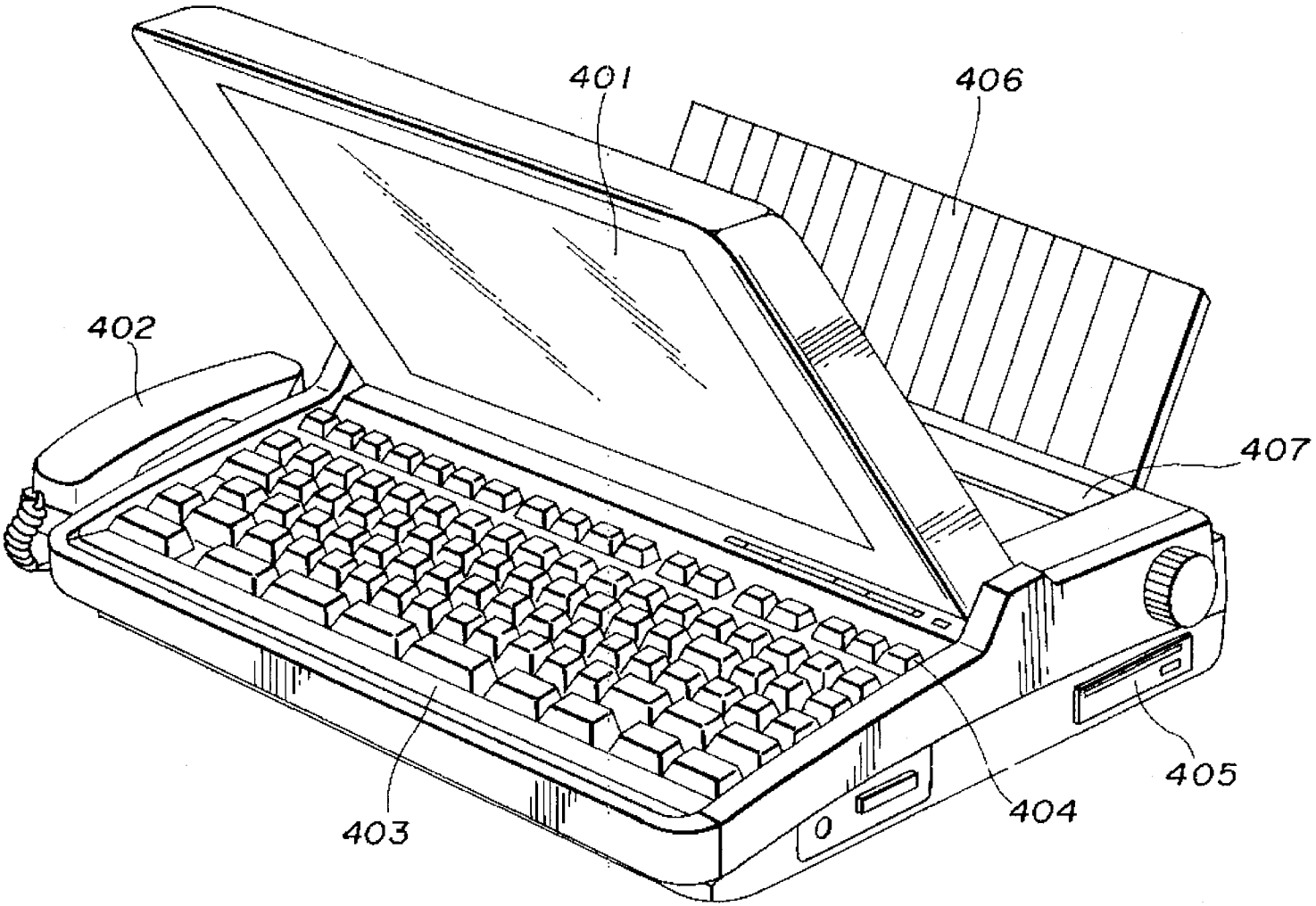
FIG. 20 is a schematic perspective view of another embodiment of an information processor incorporating the construction shown in FIG. 18.

The display 301 may be a CRT. However, a flat panel display such as a liquid crystal display utilizing a ferroelectric liquid crystal is particularly preferred as display 301, because it can be reduced in size, thickness and weight. When the information process functions as a personal computer or a word processor, various information items input through the keyboard unit 211 as shown in FIG. 18 are processed by the control unit 201 in accordance with a predetermined program to be output as an image through the printer under 206. When the information processor functions as a receiver of a facsimile machine, facsimile information input through the facsimile transmission/reception unit 208 is received and processed by the control 201 in accordance with a predetermined program to be transmitted through a communication line by the facsimile transmission/reception unit 208. The above-described information processor may be constructed as one integral unit having an ink jet printer in the main body as shown in FIG. 20. In this case, its portability is improved. In FIG. 20, components having the same functions as those shown in FIG. 19 are indicated by the reference numerals which have the same last two digits.

By the application of the recording apparatus of the present invention to the above-described multifunction type information processor, a high-quality recorded image can be obtained and the functions of the information processor can be improved.

While the present invention has been described with respect to what is currently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An ink jet apparatus for use with an ink jet head having a discharge surface with a discharge opening for discharging ink therethrough in response to discharge signals, the apparatus comprising:

a cap member for capping said discharge opening;

a wiper member for wiping said discharge surface;

suction means for applying suction to said discharge opening through said cap member to draw ink from said discharge opening; and control means for carrying out a recovery operation if said cap member is not capping said discharge opening when the ink jet apparatus is turned on, the recovery operation including first wiping said discharge surface with said wiper member, next capping said discharge opening with said cap member, next applying suction to draw ink from said discharge opening using said suction means, and thereafter discharging ink through said discharge opening using discharge signals.

2. An ink jet apparatus according to claim 1, wherein if said cap member is capping said discharge opening when the ink jet apparatus is turned on, said control means carries out a recovery operation including first releasing capping of said discharge opening with said cap member, next wiping said discharge surface with said wiper member, next discharging ink through said discharge opening using discharge signals, next capping said discharge opening with said cap member, and thereafter applying suction to draw ink from said discharge opening using said suction means.

3. An ink jet apparatus according to claim 2, wherein the amount of ink discharged using discharge signals is larger if said cap member is not capping said discharge opening when the ink jet apparatus is turned on than if said cap member is capping said discharge opening when the ink jet apparatus is turned on.

4. An ink jet apparatus according to claim 2, wherein the amount of ink drawn from said discharge opening using said suction means is larger if said cap member is not capping said discharge opening when the ink jet apparatus is turned on than if said cap member is capping said discharge opening when the ink jet apparatus is turned on.

5. An ink jet apparatus according to claim 1, further comprising a heater for controlling the temperature of said ink jet head, wherein said control means operates said heater before wiping said discharge surface with said wiper member.

6. An ink jet apparatus according to claim 1, wherein said ink jet head includes an electro-thermal converting body for generating thermal energy utilized to discharge ink from said discharge opening in response to the discharge signals.

7. An ink jet apparatus according to claim 6, wherein said ink jet head effects discharging of ink from said discharge opening by growth and contraction of a bubble generated in the ink by film boiling caused by thermal energy from said electro-thermal converting body.

8. An ink jet apparatus comprising:

an ink jet head having a discharge surface with a discharge opening for discharging ink therethrough in response to discharge signals;

a cap member for capping said discharge opening;

a wiper member for wiping said discharge surface; and control means for carrying out a basic recovery operation if said cap member is capping said discharge opening when the ink jet apparatus is turned on, the first recovery operation including wiping said discharge surface with said wiper member and discharging ink through said discharge opening using discharge signals, wherein said control means carries out an additional recovery operation if said cap member is not capping said discharge opening when the ink jet apparatus is turned on.

9. An ink jet apparatus according to claim 8, further comprising suction means for applying suction to said discharge opening through said cap member to draw ink from said discharge opening, wherein each of the basic and additional recovery operations includes capping said discharge opening with said cap member and then applying suction to draw ink from said discharge opening using said suction means.

10. An ink jet apparatus according to claim 8 or 9, wherein said control means carries out basic recovery operation once if said cap member is capping said discharge opening when the ink jet apparatus is turned on, after releasing capping of said discharge opening with said cap member, and carries out the same recovery operation twice if said cap member is not capping said discharge opening when the ink jet apparatus is turned on.

11. An ink jet apparatus according to claims 8 or 9, wherein each of the basic and additional recovery operations includes first wiping said discharge surface with said wiper member and thereafter discharging ink through said discharge opening using discharge signals.

12. An ink jet apparatus according to claim 9, wherein the additional recovery operation includes first wiping said discharge surface with said wiper member, next discharging ink through said discharge opening using discharge signals, next capping said discharge opening with said cap member, and thereafter applying suction to draw ink from said discharge opening using said suction means, and said control means releases capping of said discharge opening before performing the same recovery operation again.

13. An ink jet apparatus according to claim 8, further comprising a heater for controlling the temperature of said ink jet head, wherein said control means operates said heater before wiping said discharge surface with said wiper member.

14. An ink jet apparatus according to claim 8, wherein said ink jet head includes an electro-thermal converting body for generating thermal energy utilized to discharge ink from said discharge opening in response to the discharge signals.

15. An ink jet apparatus according to claim 14, wherein said ink jet head effects discharging of ink from said discharge opening by growth and contraction of a bubble generated in the ink film boiling caused by the thermal energy from said electro-thermal converting body.

16. An ink jet apparatus for use with an ink jet head having a discharge opening for discharging ink therethrough, the apparatus comprising:

a heater for controlling the temperature of said ink jet head;

a cap member for capping said discharge opening; and control means for operating said heater to bring said ink jet head to a first temperature if said cap member is capping said discharge opening when the ink jet apparatus is turned on and to bring said ink jet head to a second temperature higher than the first temperature if said cap member is not capping said discharge opening when the ink jet apparatus is turned on.

17. An ink jet apparatus according to claim 16, further comprising suction means for applying suction to said discharge opening through said cap member to draw ink from said discharge opening, wherein said control means operates said suction means to apply suction to said discharge opening after operating said heater.

18. An ink jet apparatus according to claim 17, wherein said control means causes said cap member to cap said discharge opening if said ink jet head does not perform recording for a predetermined time after said suction means is operated.

19. An ink jet apparatus according to claim 16, wherein said control means performs a first recovery operation after said ink jet head is brought to the first temperature and a second recovery operation different from the first recovery operation after said ink jet head is brought to the second temperature.

20. An ink jet apparatus according to claim 19, further comprising suction means for applying suction to said discharge opening through said cap member to draw ink from said discharge opening, wherein the first recovery operation includes applying suction to draw ink from said discharge opening at a first suction pressure and the second recovery operation includes applying suction to draw ink from said discharge opening at a second suction pressure higher than first suction pressure.

21. An ink jet apparatus according to claim 19, further comprising suction means for applying suction to said discharge opening through said cap member to draw ink from said discharge opening, wherein the first recovery operation includes applying suction to draw ink from said discharge opening for a first period and the second recovery operation includes applying suction to draw ink from said discharge opening for a second period longer than the first period.

22. An ink jet apparatus according to claim 19, further comprising suction means for applying suction to said discharge opening through said cap member to draw ink from said discharge opening, wherein the first recovery operation includes applying suction to draw ink from said discharge opening a first number of times and the second recovery operation includes applying suction to draw ink from said discharge opening a number of second times greater than the first number of times.

23. An ink jet apparatus according to claim 16, wherein said control means selectively carries out one of first and second recovery operations after said ink jet head is brought to the second temperature, the first recovery operation being performed if the ink jet apparatus was turned off less than a predetermined time before being turned on and the second recovery operation being performed if the ink jet apparatus was turned off for at least the predetermined time before being turned on.

24. An ink jet apparatus according to claim 23, further comprising suction means for applying suction to said discharge opening through said cap member to draw ink from said discharge opening, wherein the first recovery operation includes applying suction to draw ink from said discharge opening at a first suction pressure and the second recovery operation includes applying suction to draw ink from said discharge opening at a second suction pressure higher than said first suction pressure.

25. An ink jet apparatus according to claim 23, further comprising suction means for applying suction to said discharge opening through said cap member to draw ink from said discharge opening, wherein the first recovery operation includes applying suction to said discharge opening for a first period and the second recovery operation includes applying suction to draw ink from said discharge opening for a second period longer than said first period.

26. An ink jet apparatus according to claim 23, further comprising suction means for applying suction to said discharge opening through said cap member to draw ink from said discharge opening, wherein the first recovery operation includes applying suction to draw ink from said discharge opening a first number of times and the second recovery operation includes applying suction to said discharge opening a second number of times greater than the first number of times.

27. An ink jet apparatus according to claim 23, wherein said control means carries out the first recovery operation after said ink jet head is brought to the first temperature.

28. An ink jet apparatus according to claim 16, wherein said ink jet head includes an electro-thermal converting body for generating thermal energy utilized to discharge ink from said discharge opening.

29. An ink jet apparatus according to claim 28, wherein said ink jet head effects discharging of ink from said discharge opening by growth and contraction of a bubble generated in the ink by film boiling caused by the thermal energy from said electro-thermal converting body.

30. A recovery method for an ink jet apparatus that includes an ink jet head having a discharge surface with a discharge opening for discharging ink therethrough in response to discharge signals, a cap member for capping said discharge opening, a wiper member for wiping said discharge surface, and suction means for applying suction to said discharge opening through said cap member to draw ink from said discharge opening, wherein said recovery method is performed if said cap member is not capping said discharge opening when the ink jet apparatus is turned on and comprises the steps of:

detecting whether said cap member is capping said discharge opening;.

next wiping said discharge surface with said wiper member;

next capping said discharge opening with said cap member;

next applying suction to draw ink from said discharge opening using said suction means; and thereafter discharging ink through said discharge opening using discharge signals.

31. A recovery method for an ink jet apparatus that includes an ink jet head having a discharge surface with a discharge opening for discharging ink therethrough in response to discharge signals, a cap member for capping said discharge opening, a wiper member for wiping said discharge surface, and control means for carrying out a recovery operation when the ink jet apparatus is turned on, said recovery method comprising, if the cap member is not capping said discharge opening when the ink jet apparatus is turned on, the steps of:

performing a recovery operation including first wiping said discharge opening with said wiper member and thereafter discharging ink through said discharge opening using discharge signals; and thereafter performing an additional recovery operation.

32. A recovery method for an ink jet apparatus that includes an ink jet head having a discharge surface with a discharge opening for discharging ink therethrough, a heater for controlling the temperature of said ink jet head, and a cap member for capping said discharge opening, said recovery method comprising:

operating said heater to bring said ink jet head to a first temperature if said cap member is capping said discharge opening when the ink jet apparatus is turned on; and operating said heater to bring said ink jet head to a second temperature higher than the first temperature if said cap member is not capping said discharge opening when the ink jet apparatus is turned on.

33. A recovery method for an ink jet apparatus that includes an ink jet head having a discharge surface with a discharge opening for discharging ink therethrough, a heater for controlling the temperature of ink in said ink jet head, and a cap member for capping said discharge opening, said recovery method comprising:

operating said heater to bring said ink in said ink jet head to a first temperature if said cap member is capping said discharge opening when the ink jet apparatus is turned on; and operating said heater to bring said ink in said ink jet head to a second temperature higher than the first temperature if said cap member is not capping said discharge opening when the ink jet apparatus is turned on.

34. An ink jet apparatus for printing with an ink jet head having a discharge surface with a discharge opening for discharging ink therethrough in response to discharge signals, the apparatus comprising:

a cap member for capping said discharge opening;

a wiper member for wiping said discharge surface; and control means for carrying out a variable strength recovery operation including wiping said discharge surface with said wiper member and discharging ink through said discharge opening using discharge signals, wherein said control means carries out a first recovery operation having a predetermined strength if said cap member is capping said discharge opening when the ink jet apparatus is turned on and a second recovery operation stronger than the first recovery operation if said cap member is not capping said discharge opening when the ink jet apparatus is turned on.

35. An ink jet apparatus for printing with an ink jet head having a discharge surface with a discharge opening for discharging ink therethrough in response to discharge signals, the apparatus comprising:

a cap member for capping said discharge opening; and control means for carrying out a variable strength recovery operation including discharging ink through said discharge opening using discharge signals, wherein said control means carries out a first recovery operation having a predetermined strength if said cap member is capping said discharge opening when the ink jet apparatus is turned on and a second recovery operation stronger than the first recovery operation if said cap member is not capping said discharge opening when the ink jet apparatus is turned on.

* * * * *

UNITED STATES PATENT AND TRADEMARK OFFICE

CERTIFICATE OF CORRECTION

PATENT NO. 5,543,826

DATED : August 6, 1996

INVENTOR(S) : AKIRA KURONUMA ET AL.

It is certified that error appears in the above-identified patent and that said Letters Patent is hereby corrected as shown below:

COLUMN 2

Line 1, "type" (first occurrence) should be deleted.

COLUMN 3

Line 62, "in" should read --in a--.
Line 66, "apparatuses" should read --apparatuses on--.

COLUMN 7

Line 64, "such" should read --such as--.

COLUMN 10

Line 18, "do are cappings," should read --are capping,--.

COLUMN 13

Line 26, "A" should read --A is--.
Line 36, "on" should be deleted.
Line 55, "increasing" should read --increasing the--.

COLUMN 14

Line 12, "than" should be deleted.

UNITED STATES PATENT AND TRADEMARK OFFICE

CERTIFICATE OF CORRECTION

PATENT NO. 5,543,826

DATED : August 6, 1996

INVENTOR(S) : AKIRA KURONUMA ET AL.

It is certified that error appears in the above-identified patent and that said Letters Patent is hereby corrected as shown below:

COLUMN 15

Line 20, "step" should read --steps--.
Line 21, "step" should read --steps--.
Line 22, "(In" should read --(in--.
Line 29, "step" should read --steps-- and "(In" should read --in--.

COLUMN 17

Line 6, "as" should read --as a--.

COLUMN 18

Line 5, "when" should read --when the--.
Line 9, "processor." should read --processor commands.--.

COLUMN 19

Line 61, "out" should read --out the--.

UNITED STATES PATENT AND TRADEMARK OFFICE

CERTIFICATE OF CORRECTION

PATENT NO. 5,543,826

DATED : August 6, 1996

INVENTOR(S) : AKIRA KURONUMA ET AL.

It is certified that error appears in the above-identified patent and that said Letters Patent is hereby corrected as shown below:

COLUMN 20

Line 67, "than" should read --than the--.

COLUMN 22

Line 11, "opening;." should read --opening;--.

Signed and Sealed this

Eleventh Day of February, 1997

Bruce Lehman

*Attest:*

BRUCE LEHMAN

*Attesting Officer*

*Commissioner of Patents and Trademarks*